US010179686B2

(12) United States Patent
Bessho et al.

(10) Patent No.: US 10,179,686 B2
(45) **Date of Patent: *Jan. 15, 2019**

(54) STORAGE CONTAINER WITH HEAT STORAGE MATERIAL THAT PROVIDES HEAT TO SHELF INCLUDED IN STORAGE CONTAINER

(71) Applicant: Sharp Kabushiki Kaisha, Osaka-shi, Osaka (JP)

(72) Inventors: Hisanori Bessho, Osaka (JP); Tomoko Kase, Osaka (JP); Takashi Yamashita, Osaka (JP); Tetsuya Ide, Osaka (JP); Tomohisa Miyatani, Osaka (JP); Daiji Sawada, Osaka (JP); Yuka Utsumi, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 394 days.

This patent is subject to a terminal disclaimer.

(21) Appl. No.: 14/764,211

(22) PCT Filed: Dec. 5, 2013

(86) PCT No.: PCT/JP2013/082664

§ 371 (c)(1),
(2) Date: Jul. 29, 2015

(87) PCT Pub. No.: WO2014/119121

PCT Pub. Date: Aug. 7, 2014

(65) Prior Publication Data

US 2015/0360842 A1 Dec. 17, 2015

(30) Foreign Application Priority Data

Feb. 1, 2013 (JP) ..... 2013-018607

(51) Int. Cl.
*F25D 3/04* (2006.01)
*B65D 81/18* (2006.01)
(Continued)

(52) U.S. Cl.
CPC ..... *B65D 81/18* (2013.01); *A47B 81/00* (2013.01); *A47B 96/02* (2013.01); *A47B 96/021* (2013.01); *F25D 3/04* (2013.01)

(58) Field of Classification Search
CPC ..... F24F 5/0021; F25D 31/00; F25D 3/04; Y02E 60/147; B65D 81/18
See application file for complete search history.

(56) References Cited

U.S. PATENT DOCUMENTS 5,779,504 A * 7/1998 Dominiak ..... H01R 9/2408 439/532
8,899,183 B1 * 12/2014 Jones ..... A01K 61/008 119/218
2011/0315783 A1 * 12/2011 Baker ..... B01L 7/52 236/3

FOREIGN PATENT DOCUMENTS

JP 56-077666 A 6/1981
JP 59-120882 U 8/1984
(Continued)

OTHER PUBLICATIONS

English translation of Official Communication issued in Japanese Patent Application No. 2014-559512, dated Jun. 20, 2017.
(Continued)

*Primary Examiner* — Filip Zec
(74) *Attorney, Agent, or Firm* — Keating & Bennett, LLP

(57) ABSTRACT

The present invention is intended to provide a storage container that includes a shelf member holding a heat storage material arranged optimally. In a storage container that preserves an object at predetermined temperature, the storage container includes a storage room in which the object is preserved, and a shelf member disposed within the storage room, the shelf member including a flat portion on which the object is placed, and a heat storage material arranged to the flat portion in a way distributed depending on a temperature distribution near the flat portion within the storage room during steady operation. The heat storage material is arranged to be localized to a region of the flat portion at a relatively low-temperature side depending on the temperature distribution within the storage room.

18 Claims, 20 Drawing Sheets

(51) Int. Cl.
*A47B 81/00* (2006.01)
*A47B 96/02* (2006.01)

(56) References Cited

FOREIGN PATENT DOCUMENTS

| | | | |
|---|---|---|---|
| JP | 04-053194 | U | 5/1992 |
| JP | 08-312975 | A | 11/1996 |
| JP | 10-318652 | A | 12/1998 |
| JP | 2000-180046 | A | 6/2000 |
| JP | 2003-194414 | A | 7/2003 |
| JP | 2006-010215 | A | 1/2006 |
| JP | 2010-043779 | A | 2/2010 |
| JP | 2010-043825 | A | 2/2010 |
| WO | 2009/113309 | A1 | 9/2009 |

OTHER PUBLICATIONS

Official Communication issued in International Patent Application No. PCT/JP2013/082664, dated Feb. 10, 2014.
English translation of Official Communication issued in corresponding International Application PCT/JP2013/082664, dated Aug. 4, 2015.

* cited by examiner

FIG. 9
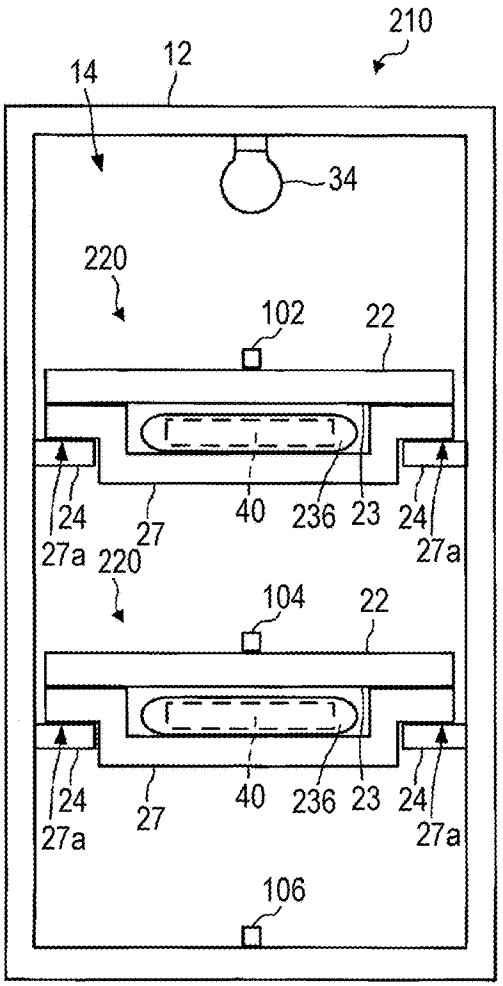
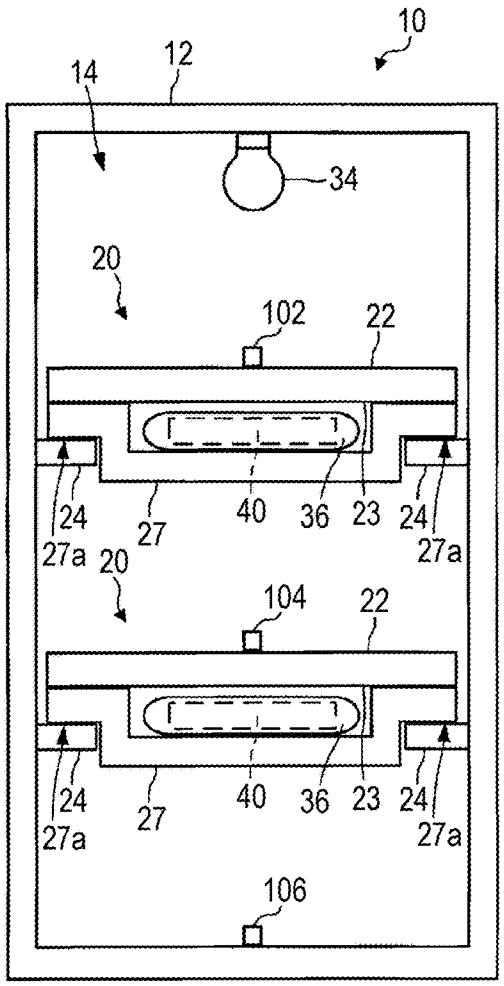

| MEASUREMENT POSITION | EMBODIMENT (lx) | COMPARATIVE EXAMPLE (lx) |
|---|---|---|
| 1 | 88.4(100%) | 87.3(100%) |
| 2 | 58.8(66.5%) | 10.1(11.6%) |
| 3 | 34.2(38.7%) | 5.3(6.1%) |

| SUBSTANCE | THICKNESS (WITH PACKAGING) | REFLECTANCE (%) | |
|---|---|---|---|
| | | LIQUID PHASE STATE | SOLID STATE |
| PARAFFIN-BASED SUBSTANCE 1 | 1.8 mm | 14.4 | 44.9 |
| | 3.1 mm | 15.8 | 55.3 |
| | 5.1 mm | 20.8 | 59.0 |
| PARAFFIN-BASED SUBSTANCE 2 | 4.1 mm | 19.2 | 51.9 |
| | 7.5 mm | 29.1 | 68.7 |
| | 14 mm | 31.3 | 72.4 |
| HYDRATE-BASED SUBSTANCE | 1.1 mm | 10.5 | 38.6 |
| | 4.7 mm | 14.4 | 49.2 |
| | 7.5 mm | 15.8 | 519 |

FIG. 19

| | | |
|---|---|---|
| STORAGE CONTAINER | DIMENSIONS (INTERNAL) OF STORAGE ROOM | : 400 mm * 300 mm * 900 mm |
| | REFLECTANCE OF INNER WALL SURFACE | : 65% {DIFFUSE REFLECTION (MEASURED VALUE OF ABS RESIN)} |
| SHELF PLATE | EXTERNAL DIMENSIONS | : 380 mm * 280 mm * 13 mm |
| | MATERIAL | : GLASS |
| STORAGE ROOM LAMP | ILLUMINOUS FLUX | : 100 LUMEN |
| | WAVELENGTH | : 550 nm |
| | LIGHT DISTRIBUTION | : ISOTROPIC EMISSION |
| HEAT STORAGE MATERIAL | OPTICAL CHARACTERISTIC OF PACKAGING SURFACE | : OPTICALLY ABSORPTIVE (ABSORBANCE: 100%) |
| | COVERAGE AREA RATIO OF HEAT STORAGE MATERIAL TO FLAT PORTION | : 100% |

FIG. 20

| (1) REFLECTANCE OF INNER WALL SURFACE | FORM 1 | | FORM 1 | | FORM 1 | | FORM 1 | | FORM 1 | | FORM 2 | | FORM 3 | |
|---|---|---|---|---|---|---|---|---|---|---|---|---|---|---|
| (2) OPTICAL CHARACTERISTIC OF PACKAGING SURFACE | FORM 4 | | FORM 5 | | FORM 6 | | FORM 4 | | FORM 4 | | FORM 6 | | FORM 6 | |
| (3) COVERAGE AREA RATIO OF HEAT STORAGE MATERIAL TO FLAT PORTION | FORM 7 | | FORM 7 | | FORM 7 | | FORM 8 | | FORM 9 | | FORM 7 | | FORM 7 | |
| ILLUMINANCE IN STORAGE ROOM | ILLUMINANCE (lx) | ILLUMINANCE (%) | ILLUMINANCE (lx) | ILLUMINANCE (%) | ILLUMINANCE (lx) | ILLUMINANCE (%) | ILLUMINANCE (lx) | ILLUMINANCE (%) | ILLUMINANCE (lx) | ILLUMINANCE (%) | ILLUMINANCE (lx) | ILLUMINANCE (%) | ILLUMINANCE (lx) | ILLUMINANCE (%) |
| UPPER STAGE IN STORAGE ROOM | 229.1 | 100.0 | 442.6 | 100.0 | 250.5 | 100.0 | 230.7 | 100.0 | 234.7 | 100.0 | 505.4 | 100.0 | 322.8 | 100.0 |
| MIDDLE STAGE IN STORAGE ROOM | 1.4 | 0.6 | 4.1 | 0.9 | 90.0 | 35.9 | 29.7 | 12.9 | 53.4 | 22.7 | 223.6 | 44.2 | 187.0 | 57.9 |
| LOWER STAGE IN STORAGE ROOM | 0.0 | 0.0 | 0.1 | 0.0 | 56.5 | 22.6 | 15.1 | 6.5 | 29.9 | 12.7 | 184.3 | 36.5 | 145.8 | 45.2 |

FIG. 21
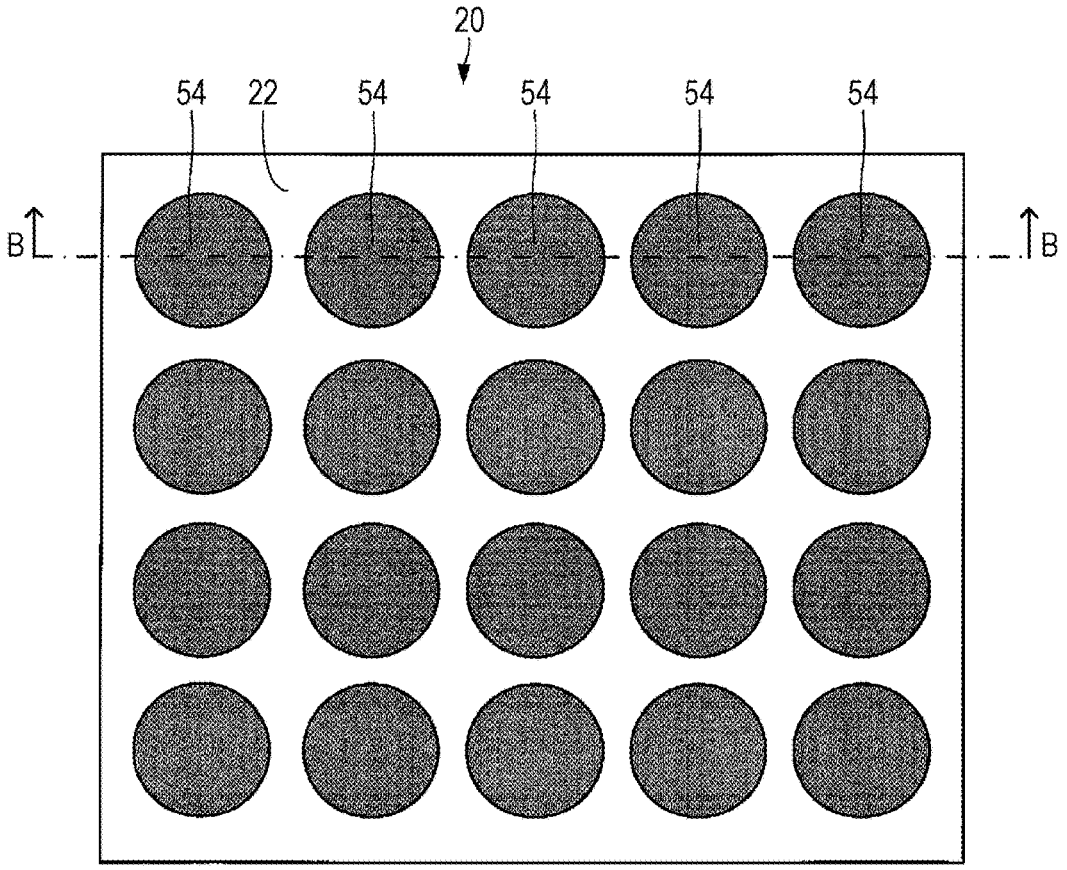
(a)
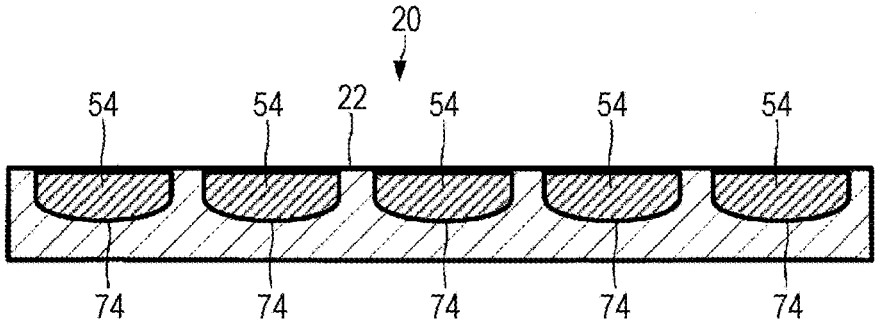
(b)

FIG. 23
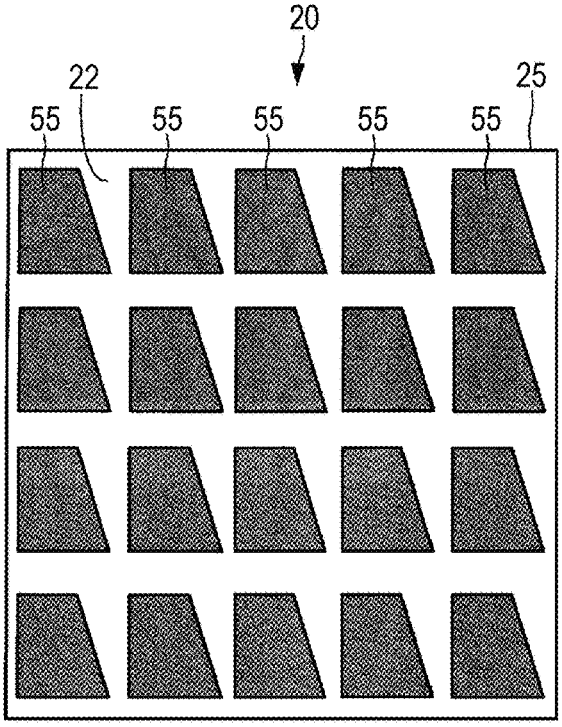
(a)
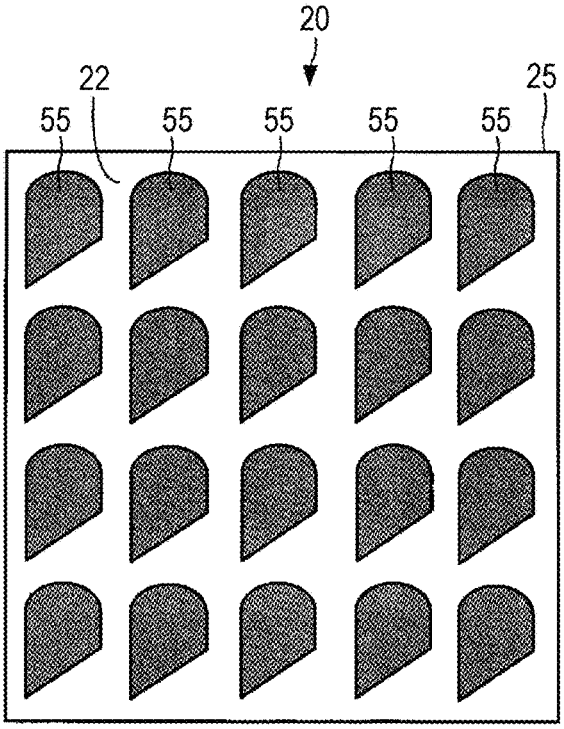
(b)

STORAGE CONTAINER WITH HEAT STORAGE MATERIAL THAT PROVIDES HEAT TO SHELF INCLUDED IN STORAGE CONTAINER

TECHNICAL FIELD

The present invention relates to a storage container, and more particularly to a storage container that preserves an object (reserve substance) at predetermined temperature.

BACKGROUND ART

For example, refrigerators and heating cabinets have been so far known as storage containers that store reserve substances at predetermined temperatures different from an outside air temperature. In the refrigerator and the heating cabinet, the temperature within a storage room comes closer to the outside air temperature when an opening/closing door of the storage room storing the reserve substances is left opened, or if the operation of a cooling apparatus or a heater is stopped upon, e.g., power outage.

Patent Literature (PTL) 1 discloses a technique of arranging heat storage materials to be held on shelf members, which are disposed in the refrigerator and on which reserve substances are placed, with intent to prevent the temperature within the refrigerator from coming closer to the outside air temperature.

CITATION LIST

Patent Literature

PTL 1: Japanese Unexamined Patent Application Publication No. 2000-180046

SUMMARY OF INVENTION

Technical Problem

However, PTL 1 just states that the heat storage materials are simply attached to the shelf members. In other words, PTL 1 neither discloses nor suggests the optimum layout when the heat storage materials are arranged and attached to the shelf members, the amounts of the heat storage materials to be arranged, and so on. Unless the heat storage materials are arranged to the shelf members in proper amounts and proper shapes, a problem occurs in that satisfactory keeping of temperature cannot be obtained with the heat storage materials. Furthermore, unless the heat storage materials are properly fixed to the shelf members in a properly protected manner, a problem occurs in that reliability of the heat storage materials degrade due to the influences of environmental changes within the storage room. Another problem is that light from a storage-room lamp for illumination of the storage room is blocked off by the heat storage materials arranged to the shelf members, and that the illuminance in a space below the heat storage material lowers. Still another problem is that, when the thickness of the shelf member including the heat storage material increases, a storage volume decreases.

An object of the present invention is to provide a storage container that includes a shelf member holding a heat storage material arranged optimally.

Solution to Problem

To achieve the above object, according to one aspect of the present invention, there is provided a storage container that preserves an object at predetermined temperature, the storage container comprising a storage room in which the object is preserved, and a shelf member disposed within the storage room, the shelf member including a flat portion on which the object is placed, and a heat storage material arranged to the flat portion in a way distributed depending on a temperature distribution near the flat portion within the storage room during steady operation.

In the above-described storage container according to the present invention, the heat storage material is arranged to be localized to a region of the flat portion at a relatively low-temperature side depending on the temperature distribution.

In the above-described storage container according to the present invention, the heat storage material is arranged in a thickness, measured from the flat portion, increasing from a high-temperature side toward the low-temperature side depending on the temperature distribution.

In the above-described storage container according to the present invention, the thickness of the heat storage material is continuously changed.

In the above-described storage container according to the present invention, the thickness of the heat storage material is discontinuously changed.

The above-described storage container according to the present invention further comprises an opening/closing door to open and close the storage room, wherein the thickness of the heat storage material increases as a distance from the opening/closing door to the heat storage material increases relatively.

In the above-described storage container according to the present invention, the heat storage material includes a plurality of latent heat storage substances, and respective phase change temperatures of the plural latent heat storage substances are different depending on the temperature distribution.

The above-described storage container according to the present invention further comprises an opening/closing door to open and close the storage room, wherein the phase change temperature is set to a lower value as a distance from the opening/closing door to the latent heat storage substance increases relatively.

To achieve the above object, according to one aspect of the present invention, there is provided a storage container that preserves an object at predetermined temperature, the storage container comprising a storage room in which the object is preserved, and a shelf member disposed within the storage room and having optical transparency, the shelf member including a flat portion on which the object is placed, and a heat storage material arranged adjacent to the flat portion.

In the above-described storage container according to the present invention, the heat storage material has optical transparency.

In the above-described storage container according to the present invention, the shelf member has optical transparency in a region in which the heat storage material is not arranged when looking at the flat portion from a normal direction.

In the above-described storage container according to the present invention, the heat storage material is arranged plural in a discrete state with respect to the flat portion.

In the above-described storage container according to the present invention, the heat storage material contains paraffin or an inorganic salt aqueous solution.

In the above-described storage container according to the present invention, the heat storage material is in a gel state.

In the above-described storage container according to the present invention, the heat storage material is arranged at a rear surface of the flat portion.

In the above-described storage container according to the present invention, the rear surface has a corrugated shape.

In the above-described storage container according to the present invention, the shelf member includes a tray disposed under the flat portion, and the heat storage material is arranged on the tray.

In the above-described storage container according to the present invention, the heat storage material is packed with a packaging.

In the above-described storage container according to the present invention, the packaging is made of a transparent material.

In the above-described storage container according to the present invention, the heat storage material is formed to be left-right asymmetric when looking at the flat portion from a normal direction.

The above-described storage container according to the present invention further comprises a storage room lamp that illuminates an interior of the storage room.

Advantageous Effects of Invention

According to the present invention, the storage container can be realized which includes the shelf member holding the heat storage material arranged optimally.

BRIEF DESCRIPTION OF DRAWINGS

FIG. 9(*a*) is a front view illustrating a schematic appearance of a storage container 10 according to a fifth embodiment of the present invention, and FIG. 9(*b*) is a front view illustrating a schematic appearance of a storage container 210 according to a comparative example.

FIG. 19 is a table indicating calculation conditions of the calculation models, which are used as an evaluation reference for the optical simulations in the seventh embodiment of the present invention.

FIG. 20 is a table indicating the results of the optical simulations in the seventh embodiment of the present invention.

FIG. 21(*a*) is an external view when looking at a flat portion 22, from a normal direction, of a shelf member 20 in a storage container according to an eighth embodiment of the present invention, and FIG. 21(*b*) is a sectional view of the shelf member 20 cut along a line B-B in FIG. 21(*a*).

FIG. 23 is an external view when looking at a flat portion 22, from a normal direction, of a shelf member 20 in the storage container according to the modification of the eighth embodiment of the present invention.

DESCRIPTION OF EMBODIMENTS

First Embodiment

A storage container 10 according to a first embodiment of the present invention is described with reference to FIGS. 1 to 5. It is to be noted that, in all drawings referred to below, individual components are illustrated in sizes and at relative dimensional ratios, which are set different from actual ones as appropriate for easier understanding. A basic configuration of the storage container 10 is first described with reference to FIG. 1.

Figure 1:
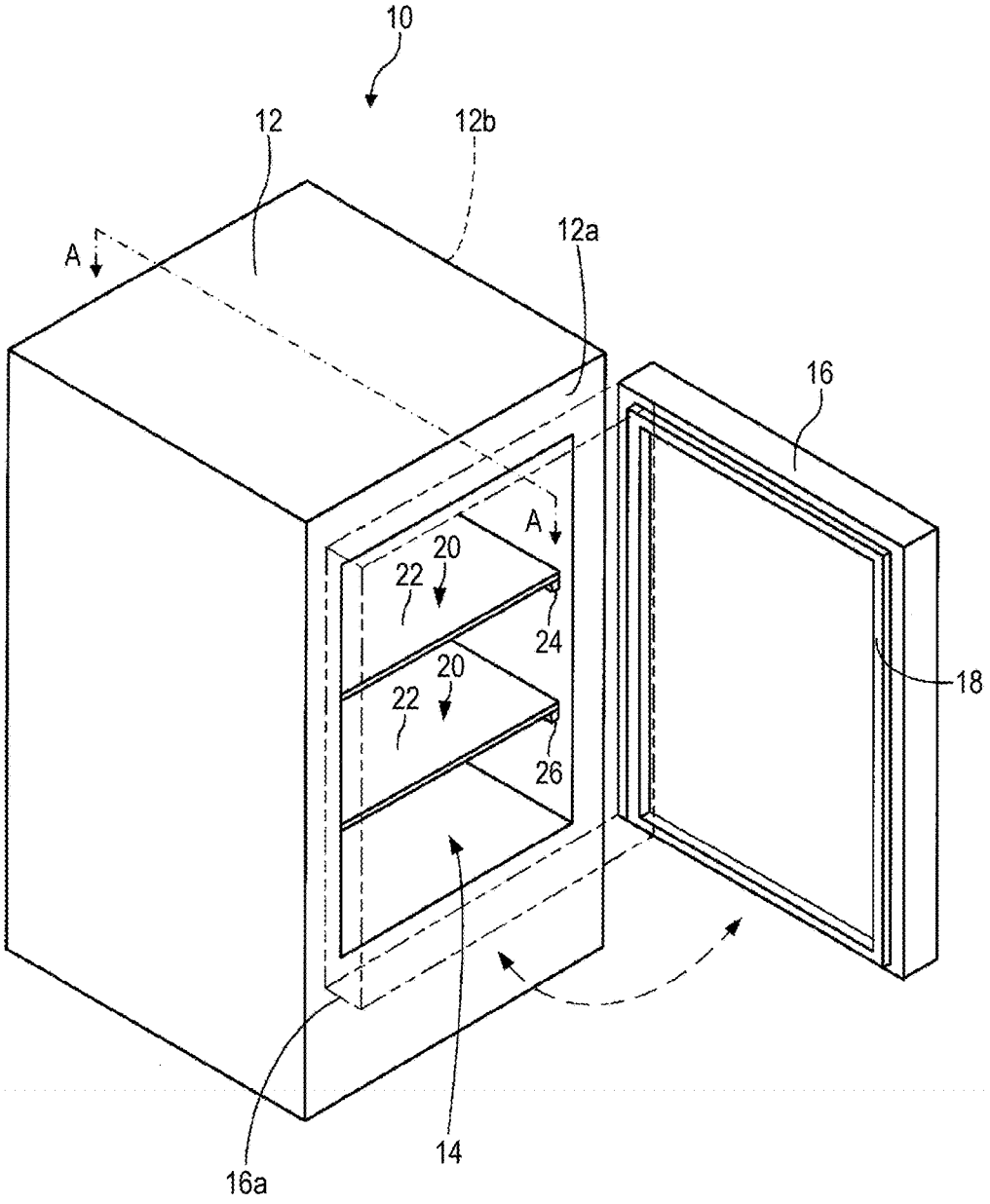
FIG. 1 is a perspective view illustrating an external appearance of a storage container 10 according to a first embodiment of the present invention.

FIG. 1 is a perspective view illustrating an external appearance of the storage container 10 according to this embodiment. The storage container 10 is used to store reserve substances at temperature different from an outside air temperature (room temperature) during steady operation, and it is utilized as, e.g., a refrigerator, a freezer, or a heating cabinet depending on a storage temperature. In this embodiment, the storage container 10 is described in connection with a refrigerator, for example. The storage container 10 includes a storage container main body 12 that has a rectangular parallelepiped shape, and that is tall in the vertical direction in an installed state. FIG. 1 illustrates a state when observing a front 12*a* of the storage container main body 12 from an obliquely upper left point. A rectangular opening is formed in the front 12*a* of the storage container main body 12. A storage room 14 in the form of a hollow box is defined inside the storage container main body 12 with an opening end of the storage room 14 given by the rectangular opening.

The storage container 10 includes an opening/closing door 16 to open and close the storage room 14. The opening/closing door 16 is mounted to the right side of the opening end of the storage room 14 at the front 12*a* through a not-illustrated hinge mechanism in an openable and closable manner. In FIG. 1, solid lines represent a state where the opening/closing door 16 is opened, and an opening/closing door 16*a* denoted by two-dot-chain lines represents a state where the opening/closing door 16 is closed. The opening/closing door 16 is in the form of a rectangular flat plate that includes a region closing the rectangular opening of the storage room 14 in the state where the opening/closing door 16 is closed. Furthermore, a door packing 18 is disposed on a surface of the opening/closing door 16, the surface opposing to an outer periphery of the front 12*a* around the rectangular opening, to increase airtightness of the storage room 14 in the door closed state. Typical materials used as the door packing 18 are synthetic rubbers, such as silicone rubber, ethylene propylene rubber, acrylic rubber, neoprene, and butyl rubber. In the present invention, however, the materials of the door packing are not limited to those examples.

The storage container 10 includes shelf members 20, which are disposed within the storage room 14 and on which reserve substances, such as foods, are placed. In this embodiment, two shelf members 20 are disposed in a way of dividing a rectangular parallelepiped space within the storage room 14 into substantially equal three parts in the vertical direction. Each of the shelf members 20 includes a flat portion 22 having a rectangular flat surface on which the reserve substances are placed. Pairs of shelf supporters 24 and 26 are disposed respectively on right and left inner walls of the storage room 14 at horizontally opposing positions. The shelf supporters 24 are disposed in an upper portion of the storage room 14. The shelf supporters 26 are disposed in a lower portion of the storage room 14. Opposite ends of the shelf members 20 are placed on the shelf supporters 24 and 26 such that the flat portions 22 are positioned horizontally relative to the vertical direction when the storage container 10 is in the installed state.

Figure 2:
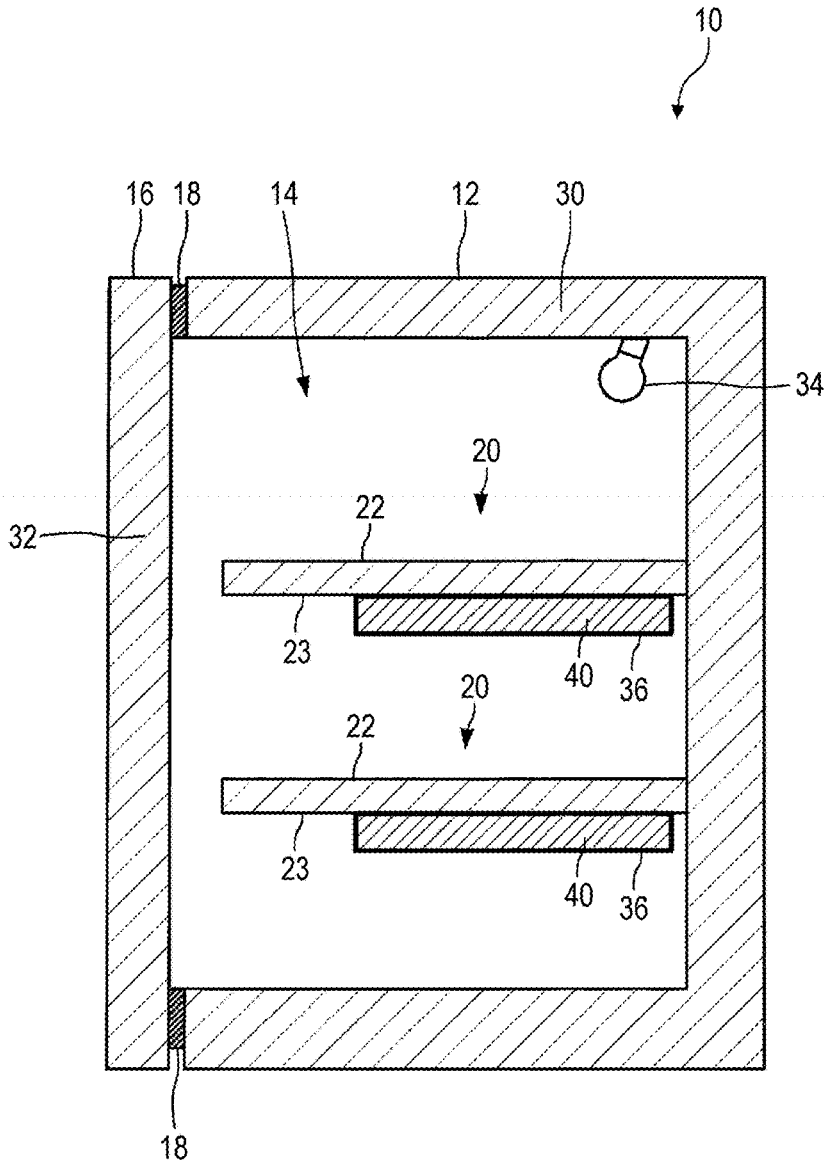
FIG. 2 is a sectional view illustrating a configuration of the storage container 10 according to the first embodiment of the present invention.

The configuration of the storage container 10 according to this embodiment will be described in detail below with reference to FIG. 2. FIG. 2 illustrates a state when observing, from a right lateral side 12*b* of the main body, a section cutting the storage container 10 along a line A-A in FIG. 1 in the vertical direction (i.e., the direction denoted by arrows attached to the line A-A) on the drawing. In the state illustrated in FIG. 2, the opening/closing door 16 is closed.

The shelf member 20 includes a heat storage material 40 arranged adjacent to the flat portion 22. The term "heat storage" implies a technique for temporarily storing heat and taking out the stored heat as required. Heat storage systems are classified into sensible heat storage, latent heat storage, chemical heat storage, etc. This embodiment utilizes the latent heat storage. With the latent heat storage system, thermal energy attributable to phase change of a substance is stored by utilizing latent heat of the substance. The latent heat storage system provides a high heat storage density and a constant output temperature. The heat storage material 40 utilizing the latent heat storage may be a latent heat storage substance, such as ice (water), paraffin (collective term of saturated chain hydrocarbons expressed by a general formula $C_nH_{2n+2}$), an inorganic salt aqueous solution, or an inorganic salt hydrate.

The inorganic salt aqueous solution used as the latent heat storage substance is, for example, an aqueous solution prepared by dissolving potassium chloride (KCl) and ammonium chloride ($NH_4Cl$) in water, or an aqueous solution prepared by dissolving sodium chloride (NaCl) and ammonium chloride ($NH_4Cl$) in water. In the present invention, however, types of the latent heat storage substance are not limited to those aqueous solutions.

The inorganic salt hydrate used as the latent heat storage substance is, for example, sodium sulfate decahydrate ($Na_2SO_4.10H_2O$), sodium acetate trihydrate, sodium thiosulfate pentahydrate, a binary composition (melting point: 5° C.) of disodium hydrogenphosphate dodecahydrate and dipotassium hydrogenphosphate hexahydrate, a binary composition (melting point: 8 to 12° C.) of lithium nitrate trihydrate, which is a main ingredient, and magnesium chloride hexahydrate, or a ternary composition (melting point: 5.8 to 9.7° C.) of lithium nitrate trihydrate—magnesium chloride hexahydrate—magnesium bromide hexahydrate. In the present invention, however, types of the latent heat storage substance are not limited to those inorganic salt hydrates.

A clathrate hydrate, etc. may be used as the cold storage material 40. The clathrate hydrate is, for example, tetrabutylammonium fluoride (phase change temperature: 25° C.), tetrabutylammonium chloride (phase change temperature: 16° C.), tetrabutylammonium bromide (phase change temperature: 11° C.), tributyl-n-pentylammonium chloride (phase change temperature: 8° C.), tributyl-n-pentylammonium bromide (phase change temperature: 6° C.), or tributyl-n-propylammonium bromide (phase change temperature: 1° C.)

The heat storage material 40 may contain a supercooling inhibitor that prevents a supercooling phenomenon caused upon phase change to a solid phase. The supercooling inhibitor is, for example, sodium sulfate ($Na_2SO_4$), borax (sodium tetraborate decahydrate) ($Na_2B_4O_7(OH)_4$-$8H_2O$), sodium tetraborate pentahydrate, sodium tetraborate nonhydrate, disodium hydrogenphosphate ($Na_2HPO_4$), silver iodide (AgI), disodium hydrogenphosphate ($Na_2HPO_4$), polyethylene glycol (molecular weight: 600 or more), or tetraalkylammonium salt. Those are merely examples of the supercooling inhibitor. In the present invention, types of the supercooling inhibitor are not limited to those examples.

The heat storage material 40 may further contain a phase separation inhibitor that prevents phase separation. Examples of the phase separation inhibitor include CMC (carboxymethyl cellulose), attapulgite clay, shavings of acrylic water-absorbent resin, sawdust, pulp, mixtures of various fibers, starch, alginic acid, silica gel, diatomaceous earth, water-soluble resin, cross-linked polyacrylate, a graft polymer of starch, a graft polymer of cellulose, a partially saponified matter of vinyl acetate-acrylic ester copolymer, cross-linked polyvinyl alcohol, cross-linked polyethylene oxide, and other high water-absorption resins, as well as natural polysaccharides and gelatin. Those are merely examples of the phase separation inhibitor. In the present invention, types of the phase separation inhibitor are not limited to those examples.

The heat storage material 40 is packed with a packaging 36 and is attached to a rear surface 23 of the flat portion 22 by an adhesive, for example. The packaging 36 is made of, e.g., a transparent material. During steady operation of the storage container 10, the heat storage material 40 is cooled to temperature lower than the phase change temperature at which phase change occurs reversibly between a solid phase and a liquid phase, and is maintained in a solid state. The phase change temperature of the heat storage material 40 can be measured by a differential scanning calorimeter (DSC). The heat storage material 40 can cool the interior of the storage room 14 by radiating cold energy when the operation of a cooling apparatus is stopped upon power outage, for example.

The adhesive used in this embodiment is mainly classified into an inorganic adhesive and an organic adhesive. The inorganic adhesive is, for example, silicate soda, cement, or ceramic. The organic adhesive is classified into a natural adhesive and a synthetic adhesive. The natural adhesive is, for example, starch or natural rubber. The synthetic adhesive is, for example, an adhesive made of thermoplastic resin, thermosetting resin, or elastomer. Those are merely examples of the adhesive, and other adhesives than mentioned above can also be used in the present invention.

The transparent material used as the packaging 36 is, for example, a plastic such as polyethylene (PE), polypropylene (PP), polystyrene (PS), ABS resin, acrylic resin (PMMA), or polycarbonate (PC). The packaging 36 may be a hard packing material in the form of a plastic container that is obtained by molding the plastic with, e.g., injection molding or blow molding, or a soft packing material made of a plastic film that is formed by the solution process, the fusion process, or the calendering process.

The heat storage material 40 is in a gel state. The heat storage material 40 contains a gelling agent that causes gelation (solidification). The term "gel" generally implies a matter that forms a three-dimensional mesh structure with partial cross-linking of molecules, and that is in a swollen state as a result of absorbing a solvent into the interior. A gel composition is substantially in a liquid phase state, but it comes into a solid state from the dynamic point of view. Even upon phase change between the solid phase and the liquid phase, the gelled heat storage material 40 maintains the solid state as a whole and does not have fluidity. The gelled heat storage material 40 is easy to handle because it can maintain the solid state thoroughly before and after the phase change.

Examples of the gelling agent include synthetic high polymers containing molecules that have one or more among a hydroxyl group, a carboxyl group, a sulfonate group, an amino group, and an amide group, natural polysaccharides, and gelatin. The synthetic high polymers are, for example, polyacrylamide derivatives, polyvinyl alcohol, and polyacrylic derivatives. The natural polysaccharides are, for example, agar, alginic acid, furcelleran, pectin, starch, a mixture of xanthane gum+locust bean gum, tamarind seed gum, gellan gum, and carrageenan. Those are merely examples of the gelling agent. In the present invention, types of the gelling agent are not limited to those examples.

The storage container 10 further include a cooling apparatus (not illustrated) that cools the storage room 14 to predetermined temperature (e.g., 3° C. to 8° C.). The storage container 10 cools the storage room 14 by operating the cooling apparatus with supply of electric power, for example. A cooling mechanism may be practiced, for example, as a vapor compression refrigerating machine, an absorption refrigerating machine, or an electronic cooling apparatus utilizing the Peltier effect. A cooling system for the storage container 10 may be of the indirect cooling type (fan type) in which cold air produced by a cooler disposed outside the storage room 14 is blown into the storage room 14 by a fan, or the direct cooling type in which the storage room 14 is directly cooled by a cooler.

A heat insulator 30 is arranged between an inner wall and an outer wall of the storage container main body 12. Furthermore, a heat insulator 32 is arranged between an inner wall and an outer wall of the opening/closing door 16. The heat insulators 30 and 32 are arranged for heat insulation to prevent heat from being conducted to the storage room 14, which is cooled to the predetermined temperature, from the outside. The heat insulators 30 and 32 are made of, e.g., a fibrous heat insulating material (such as glass wool), a foam-resin insulating material, or a vacuum insulating material.

The storage container 10 further includes a storage room lamp 34 for illuminating the interior of the storage room 14. The storage room lamp 34 is arranged, for example, at an upper inner wall of the storage room 14. When the opening/closing door 16 is in an open state, power supplied to the storage room lamp 34 is turned on to illuminate the interior of the storage room 14 such that a user of the storage container 10 can visually recognize the reserve substances. For example, an LED is used as a light source of the storage room lamp 34.

The storage container 10 is usually installed in a space where temperature is higher than that within the storage room 14. The storage container 10 is installed, for example, in a living space with a room temperature of about 20° C. When the temperature (room temperature) in the living space is higher than that within the storage room 14 as mentioned above, heat enters the storage room 14 through the vicinity of the door packing 18 even during steady operation of the storage container 10 with the opening/closing door 16 held in the closed state. Therefore, a temperature distribution generates within the storage room 14 during the steady operation. Assuming that a region closer to the opening/closing door 16 is called a front side in the storage room 14 and a region farther away from the opening/closing door 16 is called a rear side in the storage room 16, temperature gradually lowers from the front side toward the rear side in the storage room 14. In other words, the temperature within the storage room 14 is lower at a position farther away from the opening/closing door 16. During the steady operation, the temperature near the opening/closing door 16 is, e.g., 8° C., the temperature near a middle of the storage room 14 is, e.g., 5° C., and the temperature at the rear side in the storage room 14 is, e.g., 3° C. Because the flat portion 22 of the shelf member 20 is positioned to lie substantially in a horizontal plane within the storage room 14, temperature near the flat portion 22 during the steady operation also exhibits a distribution that the temperature gradually lowers from the front side toward the rear side in the storage room 14.

In an example illustrated in FIG. 2, the heat storage material 40 attached to the rear surface of the flat portion 22 of the shelf member 20 is not arranged at the front side in the storage room 14 where temperature is relatively high, and is arranged in a constant thickness over a region spanning from a position near the middle of the storage room 14 to the rear side where temperature is relatively low. Thus, the heat storage material 40 is arranged in a way distributed depending on the temperature distribution near the flat portion 22 within the storage room 14 during the steady operation. The latent heat storage substance forming the heat storage material 40 is normal (straight-chain structure) tetradecane ($C_{14}H_{30}$). The phase change temperature of normal tetradecane between the solid phase and the liquid phase is about 6° C.

In the storage container 10, the heat storage material 40 is maintained in the solid state during the steady operation. When power supply is interrupted upon power outage, for example, the interior of the storage room 14 is cooled by utilizing the latent heat of the heat storage material 40, i.e., cold energy radiated from the heat storage material 40, in the same state as that during the steady operation without exchanging the heat storage material 40. As described above, the temperature near the middle of the storage room 14 is, e.g., 5° C. and the temperature at the rear side in the storage room 14 is, e.g., 3° C. In the storage container 10, therefore, the heat storage material 40 can be maintained in the solid state even when the temperature distribution during the steady operation includes temperature higher than the phase change temperature of the heat storage material 40.

Figure 3:
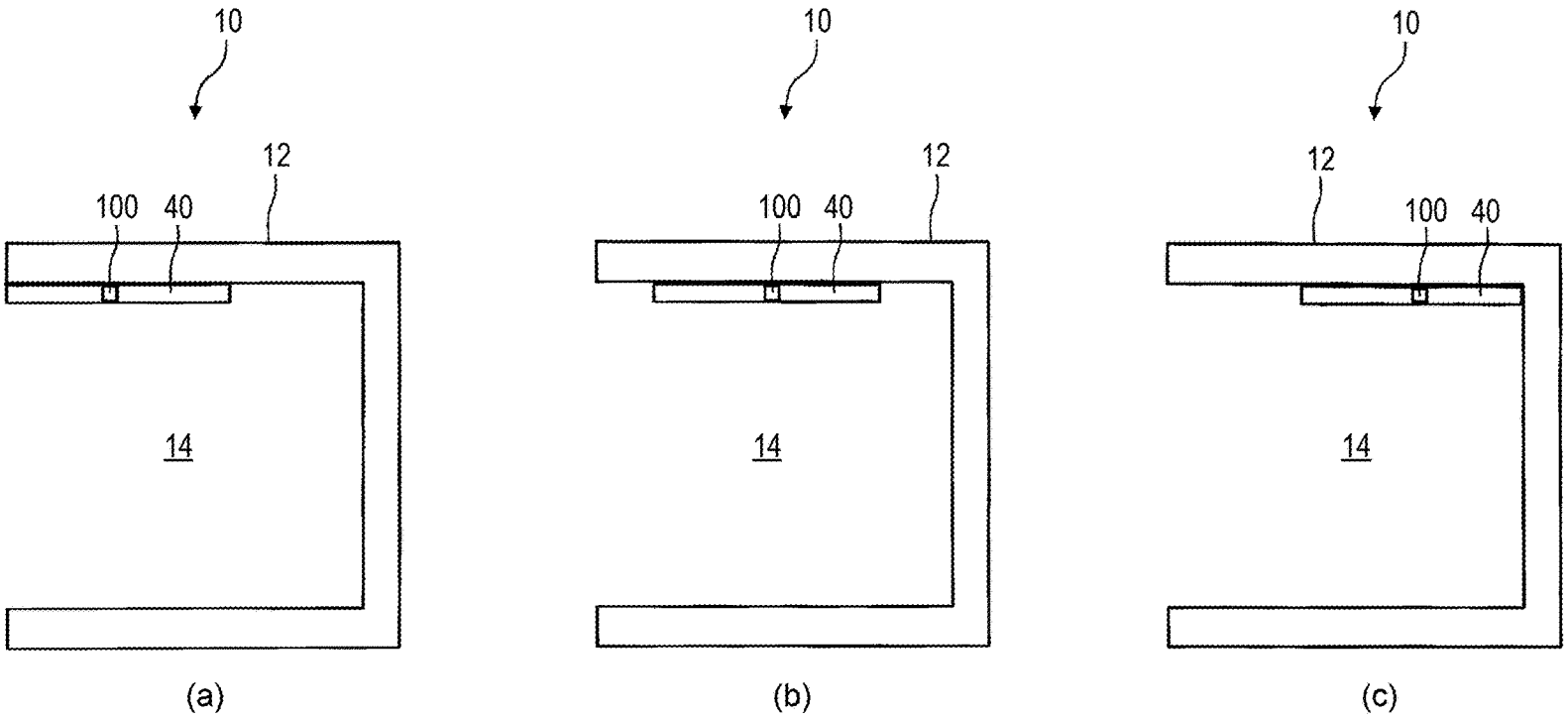
FIG. 3 is an illustration representing an example of a calculation model that is used in a simulation to analyze the relation between an arrangement position of a heat storage material 40 and a cold keeping effect in the first embodiment of the present invention.

The relation between an arrangement position of the heat storage material 40 and a cold keeping effect will be described below with reference to FIGS. 3 and 4. FIG. 3 illustrates an example of a calculation model that is used in a simulation to analyze the relation between the arrangement position of the heat storage material 40 and the cold keeping effect. In this example, the simulation was performed on condition that the arrangement position of the heat storage material 40 was changed in three patterns. FIG. 3(*a*) represents the calculation model when the heat storage material 40 is arranged at the front side in the storage room 14. FIG. 3(*b*) represents the calculation model when the heat storage material 40 is arranged at the middle of the storage room 14. FIG. 3(*c*) represents the calculation model when the heat storage material 40 is arranged at the rear side in the storage room 14. Furthermore, it is assumed that, in each of the calculation models illustrated in FIGS. 3(*a*) to 3(*c*), temperature data is taken substantially at a center 100 of the heat storage material 40.

The calculation models illustrated in FIGS. 3(*a*) to 3(*c*) are premised on that the opening/closing door 16 is opened. In FIGS. 3(*a*) to 3(*c*), the opening/closing door 16 is omitted. The simulation was performed for each calculation model on condition that the temperature in an installation place of the storage container 10 was 30° C.

Figure 4:
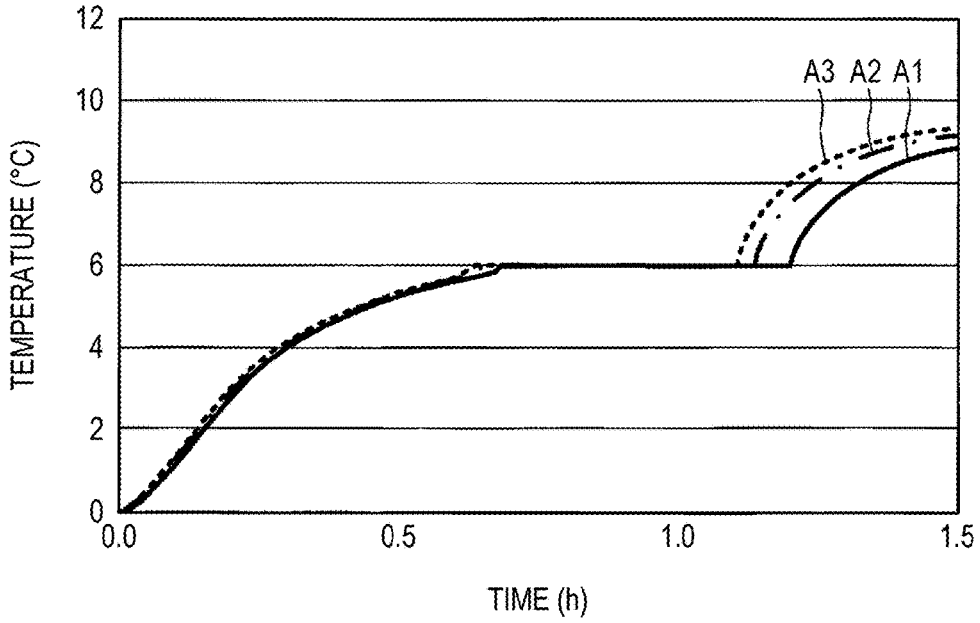
FIG. 4 is a graph plotting the simulation results in first embodiment of the present invention.

FIG. 4 plots the simulation result for each calculation model. The horizontal axis in FIG. 4 indicates the lapsed time (h), and the vertical axis indicates the temperature (° C.) within the storage room 14. Moreover, in FIG. 4, a curve A1 denoted by a solid line represents the simulation result for the calculation model of FIG. 3(*c*), a curve A2 denoted by a one-dot-chain line represents the simulation result for the calculation model of FIG. 3(*b*), and a curve A3 denoted by a dotted line represents the simulation result for the calculation model of FIG. 3(*a*).

In this example, change in temperature (° C.) within the storage room 14 with respect to the lapse time (h) was calculated on condition that an initial condition temperature within the storage room 14 was 0° C. As seen from FIG. 4, in the calculation model of FIG. 3(*a*) in which the heat storage material 40 is arranged at the front side in the storage room 14, about 1.1 hour is taken until the temperature within the storage room 14 exceeds 6° C. from 0° C. In the calculation model of FIG. 3(*b*) in which the heat storage material 40 is arranged at the middle of the storage room 14, about 1.14 hour is taken until the temperature within the storage room 14 exceeds 6° C. from 0° C. In the calculation model of FIG. 3(*c*) in which the heat storage material 40 is arranged at the rear side in the storage room 14, about 1.2 hour is taken until the temperature within the storage room 14 exceeds 6° C. from 0° C.

From this simulation, it has been confirmed that, when the heat storage material 40 is arranged at the rear side in the storage room 14, the temperature within the storage room 14 can be kept at 6° C. or below for the longest time. Stated in another way, it has been confirmed that, when the heat storage material 40 is arranged at the rear side in the storage room 14, the heat storage material 40 can be maintained in the solid state for the longest time on condition of the opening/closing door 16 being left open. It is hence understood that, in actual use of the storage container 10 with the opening/closing door 16 being opened and closed, the effect of keeping the storage room 14 cold is increased by arranging the heat storage material 40 at the rear side in the storage room 14.

In the storage container 10 according to this embodiment, the heat storage material is arranged to be localized to a region of the flat portion 22 at a relatively low-temperature side depending on the temperature distribution near the flat portion 22. More specifically, in the storage container 10 according to this embodiment, the heat storage material 40 is not arranged at the front side in the storage room 14, and it is arranged over a region spanning from the position near the middle of the storage room 14 to the rear side. Thus, in this embodiment, since the heat storage material 40 is arranged over the region spanning from the position near the middle of the storage room 14 to the rear side where the temperature is less susceptible to the influence of heat incoming from the outside, the heat storage material 40 can be maintained in the solid state during the steady operation. Furthermore, in case of power outage, the interior of the storage room 14 can be continuously cooled by utilizing the latent heat of the heat storage material 40 in the same state as that during the steady operation without exchanging the heat storage material 40. Hence the storage container 10 according to this embodiment can satisfactorily keep the temperature with the aid of the heat storage material 40 even in case of power outage.

Moreover, in the storage container 10 according to this embodiment, since the heat storage material 40 is not arranged at the front side in the storage room 14 where temperature rises due to heat incoming upon opening of the opening/closing door 16, the heat storage material 40 is not liquefied even when the temperature at the front side in the storage room 14 rises during the steady operation upon opening of the opening/closing door 16.

Since the heat storage material 40 is arranged to the shelf member 20 in the storage room 14 as described above, the temperature within the storage room 14 can be kept at the predetermined temperature without interfering with storage of the reserve substances. With this embodiment, since the heat storage material 40 is arranged to the shelf member 20 in a proper amount and in a proper shape, satisfactory keeping of temperature can be realized with the heat storage material 40.

Modification

Figure 5:
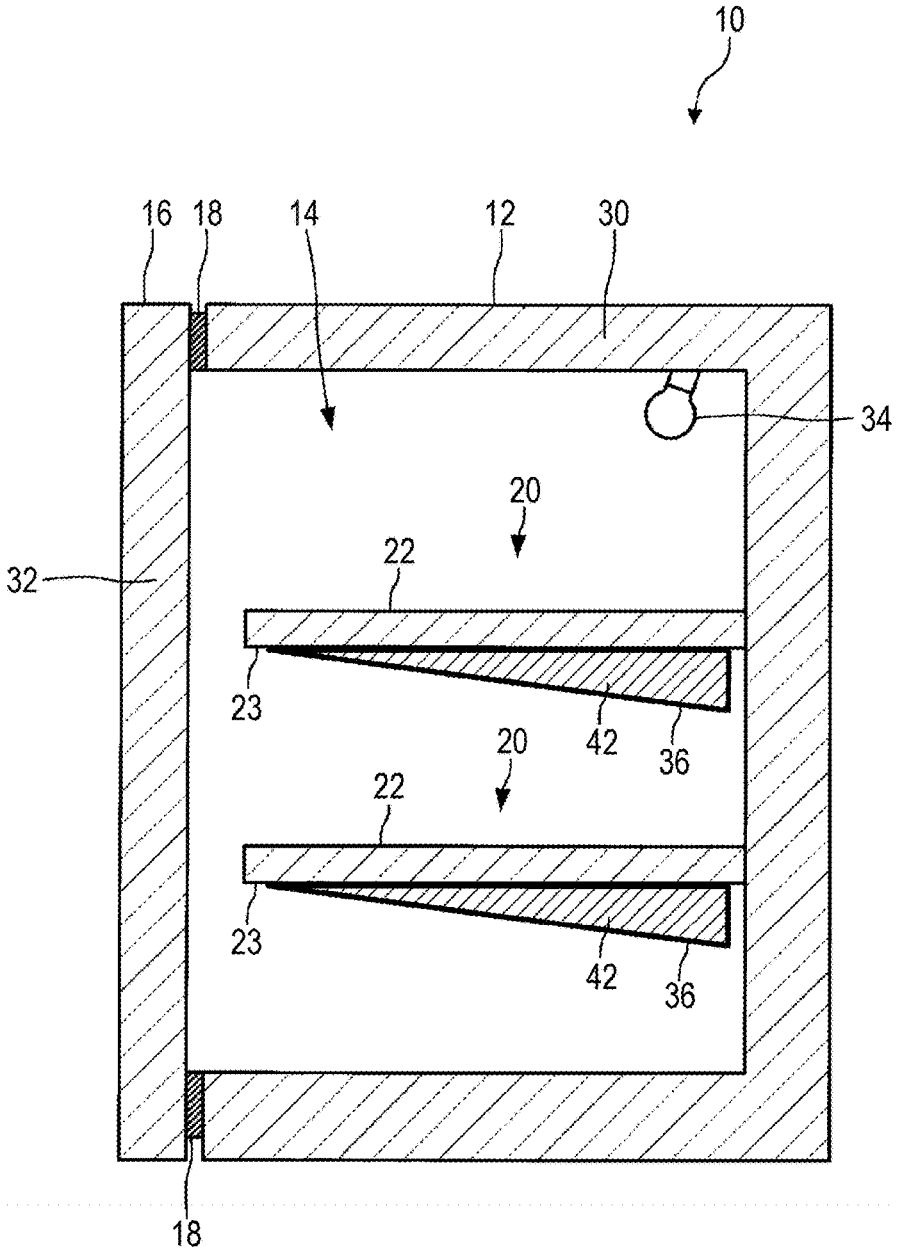
FIG. 5 is a sectional view illustrating a configuration of a storage container 10 according to a modification of the first embodiment of the present invention.

A storage container 10 according to a modification of this embodiment will be described below with reference to FIG. 5. FIG. 5 is a sectional view of the storage container 10 when viewed from the same direction as in FIG. 2. A heat storage material 42 is arranged adjacent to the flat portion 42 in a way distributed depending on the temperature distribution near the flat portion 22.

The storage container 10 according to the modification is featured in the heat storage material 42. The heat storage material 42 is arranged in a thickness, measured from the flat portion 22, increasing from a high-temperature side toward a low-temperature side depending on the temperature distribution near the flat portion 22. Furthermore, the thickness of the heat storage material 40 in the storage container 10 changes continuously. As illustrated in FIG. 5, the heat storage material 42 has such a shape that the thickness linearly increases from the front side toward the rear side in the storage room 14.

Thus, in the storage container 10 according to the modification, the heat storage material 42 is arranged such that the thickness from the flat portion 22 increases from the high-temperature side toward the low-temperature side depending on the temperature distribution near the flat portion 22. Moreover, the thickness of the heat storage material 40 in the storage container 10 changes continuously. In addition, the thickness of the heat storage material 40 in the storage container 10 increases as a distance from the opening/closing door 16 to the heat storage material increases relatively.

With the storage container 10 according to the modification, since the heat storage material 40 is arranged to be localized to the region spanning from the position near the middle of the storage room 14 to the rear side where the temperature is less susceptible to the influence of heat incoming from the outside, most of the heat storage material 40 is maintained in the solid state during the steady operation. In case of power outage, the interior of the storage room 14 can be continuously cooled by utilizing the latent heat of the heat storage material 40 in the same state as that during the steady operation without exchanging the heat storage material 40. Hence the storage container 10 according to this modification can satisfactorily keep the temperature with the aid of the heat storage material 40 even in case of power outage.

Furthermore, according to the modification, the heat storage material 40 is arranged in a smaller amount at the front side in the storage room 14 where a temperature rise due to heat incoming upon opening of the opening/closing door 16 is comparatively significant during the steady operation. Therefore, if the heat storage material 40 arranged at the front side in the storage room 14 is liquefied due to the temperature rise caused by the opening of the opening/closing door 16, the heat storage material 40 existing in the small amount at the front side in the storage room 14 can be solidified in a short time with cooling of the storage room 14 by the cooling mechanism after the opening/closing door 16 has been closed.

While the thickness of the heat storage material 42 in this modification changes linearly, the change in thickness of the heat storage material 42 is not limited to that example. In another example, the thickness of the heat storage material 42 may increase exponentially from the high-temperature side toward the low-temperature side depending on the temperature distribution near the flat portion 22. Thus, the thickness of the heat storage material 42 may be changed continuously as in those examples. As an alternative, the thickness of the heat storage material 42 may increase in a stepwise manner from the high-temperature side toward the low-temperature side depending on the temperature distribution near the flat portion 22. In other words, the thickness of the heat storage material 42 may be changed discontinuously. It is just required that the thickness of the heat storage material 42 increases as the distance from the opening/closing door 16 to the heat storage material increases relatively.

With the storage container 10 according to this modification, since the heat storage material 42 is arranged in a proper amount and in a proper shape, satisfactory keeping of temperature can be realized with the heat storage material 42.

Second Embodiment

Figure 6:
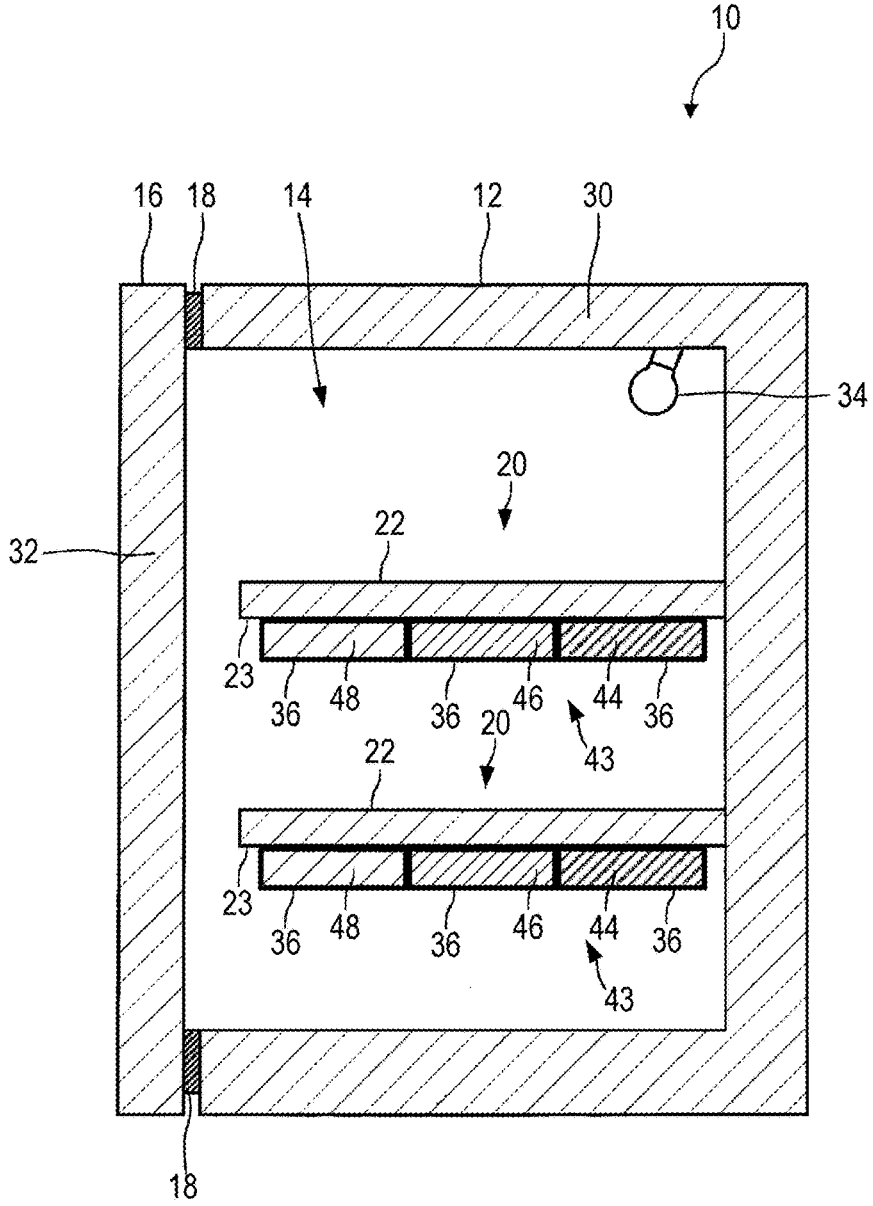
FIG. 6 is a sectional view illustrating a configuration of a storage container 10 according to a second embodiment of the present invention.

A storage container 10 according to a second embodiment of the present invention will be described below with reference to FIG. 6. FIG. 6 is a sectional view of the storage container 10 when viewed from the same direction as in FIG. 2. It is to be noted that components having the same functions and operating in the same manners as those in the first embodiment are denoted by the same reference signs, and description of those components is omitted. The storage container 10 according to this embodiment is featured in including a plurality of heat storage materials having different phase change temperatures.

A shelf member 20 of the storage container 10 includes a flat portion 22 and a heat storage material 43 that is arranged at a rear surface 23 of the flat portion 22. The heat storage material 43 includes latent heat storage substances 44, 46 and 48. The latent heat storage substance 44 is arranged at the rear surface 23 of the flat portion 22 at the rear side in the storage room 14. The latent heat storage substance 46 is arranged at the rear surface 23 of the flat portion 22 at the middle of the storage room 14. The latent heat storage substance 48 is arranged at the rear surface 23 of the flat portion 22 at the front side in the storage room 14. The latent heat storage substances 44, 46 and 48 are each packed with a packaging 36 and attached to the rear surface 23 of the shelf member 20 by an adhesive, for example. The latent heat storage substances 44, 46 and 48 are in a gel state.

For example, ice (water) having the phase change temperature of 0° C. is used as the latent heat storage substance 44. The temperature at the rear side in the storage room 14 near the flat portion 22 is about 3° C. as described above, but it is locally reduced to a lower level. For example, when the storage container 10 is a refrigerator of the indirect cooling type, a supply opening of cold air for cooling the storage room 14 is positioned at the rear side in the storage room 14. The temperature of the cold air for cooling the storage room 14 to about 3° C. to 8° C. is about −2° C. to 0° C. Accordingly, the latent heat storage substance 44 is cooled to 0° C. or below by the cold air blown through the supply opening at the rear side in the storage room 14, and is brought into the solid state.

In another example, when the storage container 10 is a refrigerator of the direct cooling type, a cooler is disposed at the rear side in the storage room 14, and the temperature near the cooler at the rear side in the storage room 14 is 0° C. or below. Accordingly, the latent heat storage substance 44 using water is cooled to 0° C. or below and is brought into the solid state because the latent heat storage substance 44 is arranged near the cooler.

For example, normal tetradecane ($C_{14}H_{30}$) having the phase change temperature of about 6° C. is used as the latent heat storage substance 46. The temperature near at the middle of the storage room 14 is about 5° C. Accordingly, the latent heat storage substance 46 is cooled to temperature lower than its phase change temperature and is brought into the solid state.

For example, normal pentadecane ($C_{15}H_{32}$) having the phase change temperature of about 9.9° C. is used as the latent heat storage substance 48. The temperature near at the front side in the storage room 14 is about 8° C. Accordingly, the latent heat storage substance 48 is cooled to temperature lower than its phase change temperature and is brought into the solid state.

Thus, the heat storage material 43 includes the plurality of latent heat storage substances 44, 46 and 48. The phase change temperatures of the latent heat storage substances 44, 46 and 48 are different from one another depending on the temperature distribution near the flat portion 22. The phase change temperatures of the latent heat storage substances 44, 46 and 48 are set to lower values as the distances from the opening/closing door 16 to the latent heat storage substances increase relatively. As described above, the phase change temperature of the latent heat storage substance 44 is 0° C., the phase change temperature of the latent heat storage substance 46 is 6° C., and the phase change temperature of the latent heat storage substance 48 is 9° C.

With the storage container 10 according to this embodiment, the latent heat storage substances 44, 46 and 48 can be maintained in the solid state during the steady operation. When supply of electric power is interrupted upon, e.g., power outage, the temperature in the storage room 14 can be kept by utilizing the latent heat of the latent heat storage substances 44, 46 and 48. Furthermore, according to this embodiment, since the storage container 10 includes the plurality of latent heat storage substances 44, 46 and 48 having the different phase change temperatures depending on the temperature distribution near the flat portion 22, satisfactory keeping of the temperature within the storage room 14 can be realized with the heat storage material 43.

In case of power outage, the interior of the storage room 14 can be continuously cooled by utilizing the latent heat of the heat storage material 40 in the same state as that during the steady operation without exchanging the heat storage material 40. Hence the storage container 10 according to this embodiment can satisfactorily keep the temperature with the aid of the heat storage material 40 even in case of power outage.

Moreover, according to this embodiment, the heat storage material 48 having the relatively high phase change temperature is arranged at the front side in the storage room 14 where a temperature rise due to heat incoming upon opening of the opening/closing door 16 is comparatively significant during the steady operation. Therefore, if the heat storage material 48 arranged at the front side in the storage room 14 is liquefied due to the temperature rise caused by the opening of the opening/closing door 16, the heat storage material 48 at the front side in the storage room 14 can be solidified in a short time with cooling of the storage room 14 by the cooling mechanism after the opening/closing door 16 has been closed.

Third Embodiment

Figure 7:
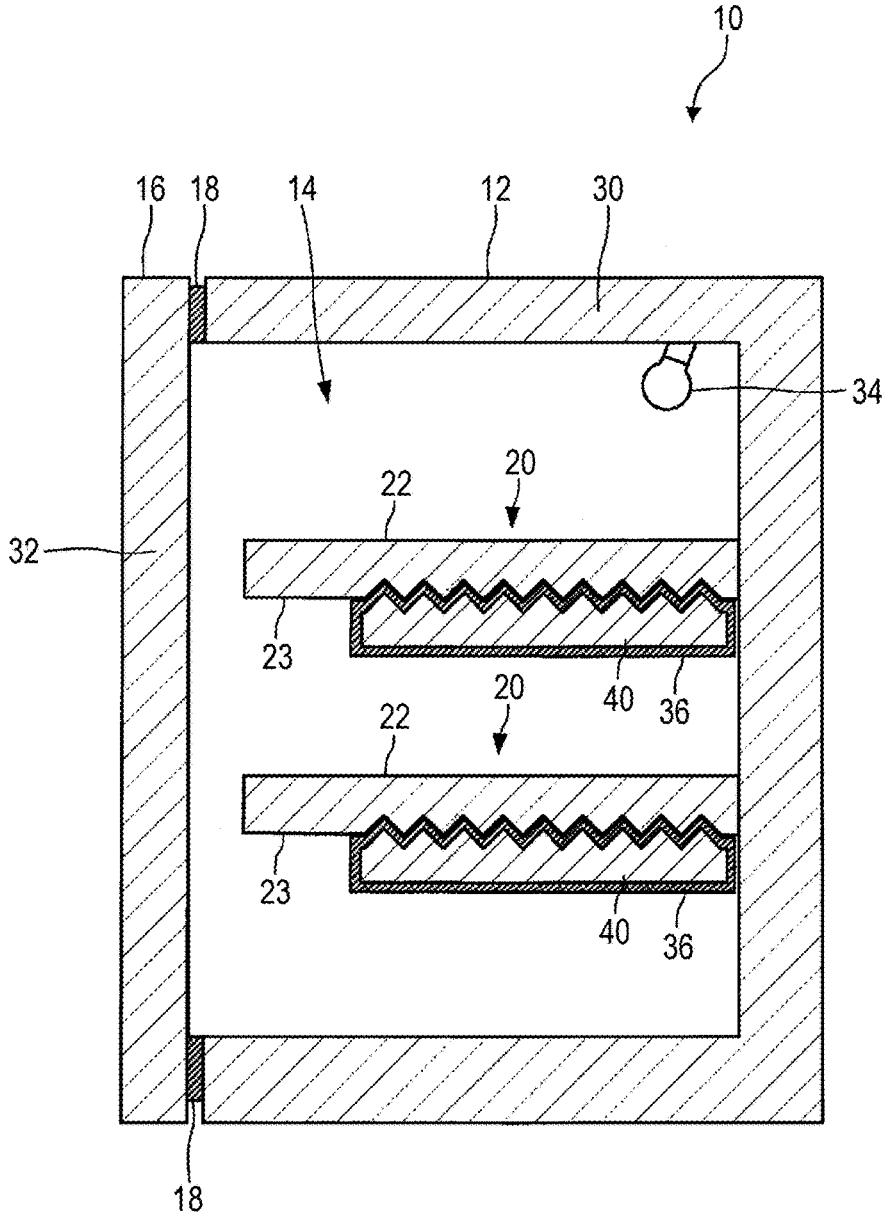
FIG. 7 is a sectional view illustrating a configuration of a storage container 10 according to a third embodiment of the present invention.

A storage container 10 according to a third embodiment of the present invention will be described below with reference to FIG. 7. FIG. 7 is a sectional view of the storage container 10 when viewed from the same direction as in FIG. 2. It is to be noted that components having the same functions and operating in the same manners as those in the above embodiments are denoted by the same reference signs, and description of those components is omitted. The storage container 10 according to this embodiment is featured in a shape of the rear surface 23 of the flat portion 22 of the shelf member 20.

The rear surface 23 of the flat portion 22 of the shelf member 20 has a corrugated shape. The heat storage material 40 packed with the packaging 36 is attached to the rear surface 23 by an adhesive, for example. Since the rear surface 23 has the corrugated shape to increase a contact area between the rear surface and the heat storage material 40 in comparison with the case of the rear surface 23 being flat, adhesion between the heat storage material 40 and the rear surface is increased. As a result, the heat storage material 40 can be prevented from peeling off from the shelf member 20. With the storage container 10 according to this embodiment, since the heat storage material 40 is properly fixed to the shelf member 20 for protection, reliability of the heat storage material 40 can be improved.

Fourth Embodiment

A storage container according to a fourth embodiment of the present invention will be described below with reference to FIG. 8. It is to be noted that components having the same functions and operating in the same manners as those in the above embodiments are denoted by the same reference signs, and description of those components is omitted. Several examples of mounting of the heat storage material 40 to the vicinity of the flat portion 22 of the shelf member 20 are described in this embodiment. While the heat storage material 40 is packed with the packaging 36, the packaging 36 may be omitted in this embodiment. Each of FIGS. 8(*a*) to 8(*d*) depicts a section when looking at the shelf member 20 disposed on the shelf supporters 24 from the front of the storage container.

Figure 8:
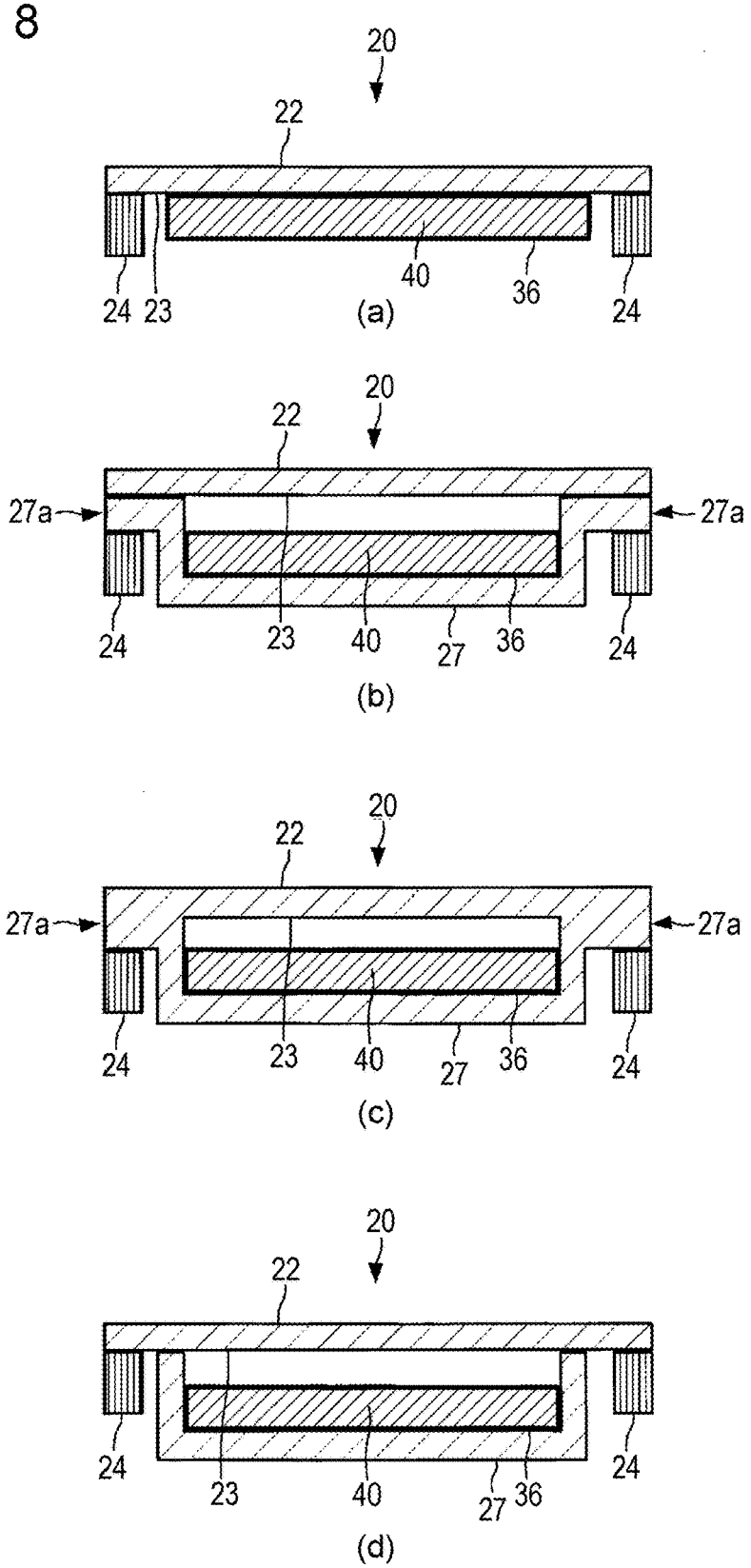
FIG. 8 is an illustration to explain examples of mounting of a heat storage material 40 to a shelf member 20 in a storage container according to a fourth embodiment of the present invention.

FIG. 8(*a*) depicts an example in which the heat storage material 40 is arranged in close contact with the rear surface 23 of the flat portion 22. This example has the same configuration as that of the shelf member 20 illustrated in the first embodiment. The rear surface 23 may have a corrugated shape as illustrated in FIG. 7.

The shelf member 20 illustrated in FIG. 8(*b*) includes a tray 27 in addition to the flat portion 22 and the heat storage material 40. The tray 27 has a pair of elongate edge portions 27*a* that extend parallel to each other, and that can be disposed on the pair of the shelf supporters 24. A recess with a depth allowing the heat storage material 40 in the form of a thin plate to be accommodated therein is formed between the pair of edge portions 27*a*. The flat portion 22 is arranged to cover the recess over a region spanning from one of the edge portions 27*a* to the other. Regions of the rear surface 23 of the flat portion 22 positioned above the pair of shelf supporters 24 and upper surfaces of the pair of edge portions 27*a* are bonded to each other, respectively. As a result, the heat storage material 40 is enclosed in a closed space formed by the recess of the tray 27 and the rear surface 23 of the flat portion 22.

The shelf member 20 illustrated in FIG. 8(*c*) includes the tray 27 in addition to the flat portion 22 and the heat storage material 40. The regions of the flat portion 22 positioned above the pair of shelf supporters 24 and the pair of edge portions 27*a* are formed integrally with each other. The remaining configuration is the same as that of the shelf member 20 illustrated in FIG. 8(*b*). The heat storage material 40 is enclosed in a closed space formed by the recess of the tray 27 and the rear surface 23 of the flat portion 22.

The shelf member 20 illustrated in FIG. 8(*d*) includes a tray 27 in addition to the flat portion 22 and the heat storage material 40. The tray 27 has a recess with a depth allowing the heat storage material 40 in the form of a thin plate to be accommodated therein. The flat portion 22 is arranged to extend over a region spanning from one of the shelf supporters 24 to the other while covering the recess. End portions of the tray 27 defining the recess and the rear surface 23 of the flat portion 22 are bonded to each other. As a result, the heat storage material 40 is enclosed in a closed space formed by the recess of the tray 27 and the rear surface 23 of the flat portion 22.

With the storage container according to this embodiment, as described above, since the heat storage material 40 is properly fixed to and protected by the flat portion 22 of the shelf member 20 and the tray 27, it is possible to prevent undesired mechanical stress from being exerted on the shelf member 20, and to avoid reduction of reliability of the heat storage material 40, which may be caused by the influences of environmental changes in the storage room 14.

Fifth Embodiment

A storage container 10 according to a fifth embodiment of the present invention will be described below with reference to FIGS. 9 to 15. It is to be noted that components having the same functions and operating in the same manners as those in the above embodiments are denoted by the same reference signs, and description of those components is omitted. FIG. 9(*a*) is a front view illustrating a schematic appearance of the storage container 10 according to this embodiment. FIG. 9(*b*) is a front view illustrating a schematic appearance of a storage container 210 according to a comparative example. In FIGS. 9(*a*) and 9(*b*), the opening/closing door 16 is omitted.

In this embodiment, comparative evaluation was performed on illuminance in the storage room 14 between the case of the heat storage material 40 being packed with a transparent packaging 36 (example illustrated in FIG. 9(*a*)) and the case of the heat storage material 40 being packed with an opaque packaging 236 (example illustrated in FIG. 9(*b*)). The shelf member 20 in the storage container 10 according to this embodiment, illustrated in FIG. 9(*a*), includes the flat portion 22, the tray 27, and the heat storage material 40 arranged on the tray 27 and packed with the packaging 36. A shelf member 220 in the storage container 210 according to the comparative example, illustrated in FIG. 9(*b*), includes the flat portion 22, the tray 27, and the heat storage material 40 arranged on the tray 27 and packed with the packaging 236. The flat portion 22 is made of a transparent material, such as transparent resin or glass. In this embodiment, the comparative evaluation was performed by employing the flat portion 22 made of transparent glass with a thickness of 4 mm.

For example, transparent resin, e.g., polycarbonate (PC), polymethacrylic acid (PMMA), or polystyrene (PS), is used as the tray 27 supporting the heat storage material 40. In this embodiment, the comparative evaluation was performed by employing the tray 27 made of polycarbonate with a thickness of 1.0 mm.

Furthermore, in this embodiment, the comparative evaluation was performed by employing the heat storage material 40 prepared by gelling paraffin (normal tetradecane) with a polymer-based gelling agent. For example, polyethylene terephthalate (PET), polycarbonate (PC), or an aluminum material is used as the packaging to pack the heat storage material 40. The comparative evaluation was performed by employing, as the packaging 36, a transparent film prepared by bonding nylon (with a thickness of 15 μm) and polyethylene terephthalate (with a thickness of 60 μm) in the storage container 10 according to this embodiment, and by employing, as the packaging 236, an aluminum film prepared by vapor-depositing an aluminum foil (with a thickness of 2 μm) and polyethylene terephthalate (with a thickness of 60 μm) in the storage container 210 according to the comparative example.

Moreover, in this embodiment, the comparative evaluation was performed by setting an illuminance meter 102 on the upper surface of the flat portion 22 of the shelf member 20, which was disposed in the upper portion of the storage room 14, to measure the illuminance at an upper stage in the storage room 14, an illuminance meter 104 on the flat portion 22 of the shelf member 20, which was disposed in the lower portion of the storage room 14, to measure the illuminance at a middle stage in the storage room 14, and an illuminance meter 106 on a bottom surface of the storage room 14 to measure the illuminance at a lower stage in the storage room 14. A digital illuminance meter "IM-5" made by TOPCON CORPORATION was used as the illuminance meter.

Figures 10, 11:
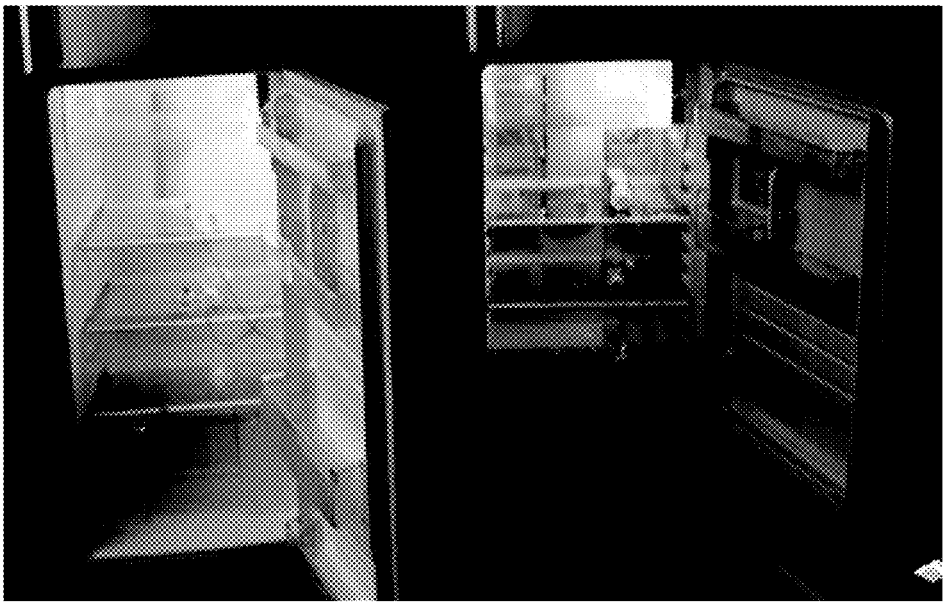
FIG. 10 is a table indicating the results of comparative evaluation of illuminance in a storage room 14 between the storage container 10 according to the fifth embodiment of the present invention and the storage container 210 according to the comparative example.
FIG. 11 represents photographs taken in the comparative evaluation of illuminance in the storage room 14 between the storage container 10 according to the fifth embodiment of the present invention and the storage container 210 according to the comparative example.

FIG. 10 indicates the results of the comparative evaluation performed in this embodiment. The item "Measurement Positon" in FIG. 10 corresponds to the result measured by each illuminance meter. More specifically, "1" in the column "Measurement Positon" indicates the measurement result for the upper stage in the storage room 14 with the illuminance meter 102 illustrated in FIG. 9. Also, "2" in the column "Measurement Positon" indicates the measurement result for the middle stage in the storage room 14 with the illuminance meter 104 illustrated in FIG. 9. Furthermore, "3" in the column "Measurement Positon" indicates the measurement result for the lower stage in the storage room 14 with the illuminance meter 106 illustrated in FIG. 9. The item "Embodiment (lx)" in FIG. 10 indicates the measurement result of illuminance in the storage container 10 according to this embodiment. The item "Comparative Example (lx)" in FIG. 10 indicates the measurement result of illuminance in the storage container 210 according to the comparative example.

As seen from FIG. 10, in the storage container 10 according to this embodiment, the measurement result for the upper stage in the storage room 14 with the illuminance meter 102 is 88.4 lx, the measurement result for the middle stage in the storage room 14 with the illuminance meter 104 is 58.8 lx, and the measurement result for the lower stage in the storage room 14 with the illuminance meter 106 is 34.2 lx. Taking the illuminance at the upper stage in the storage room 14 as a reference, the illuminance at the middle stage in the storage room 14 is 66.5% of that at the upper stage in the storage room 14, and the illuminance at the lower stage in the storage room 14 is 38.7% of that at the upper stage in the storage room 14.

On the other hand, in the storage container 210 according to the comparative example, the measurement result for the upper stage in the storage room 14 with the illuminance meter 102 is 87.3 lx, the measurement result for the middle stage in the storage room 14 with the illuminance meter 104 is 10.1 lx, and the measurement result for the lower stage in the storage room 14 with the illuminance meter 106 is 5.3 lx. Taking the illuminance at the upper stage in the storage room 14 as a reference, the illuminance at the middle stage in the storage room 14 is 11.6% of that at the upper stage in the storage room 14, and the illuminance at the lower stage in the storage room 14 is 6.1% of that at the upper stage in the storage room 14.

Thus, in the storage container 10 according to this embodiment using, as the packaging 36, the transparent film prepared by bonding nylon (with a thickness of 15 μm) and polyethylene terephthalate (with a thickness of 60 μm), it is possible to, in comparison with the illuminance (88.4 lx) at the upper stage in the storage room 14, ensure the illuminance (58.8 lx), i.e., about 66.5% of the former, at the middle stage in the storage room 14. Furthermore, the storage container 10 according to this embodiment can provide the illuminance five times or more as much as that in the storage container 210 according to the comparative example at the middle stage in the storage room 14.

Moreover, in the storage container 10 according to this embodiment, it is possible to, in comparison with the illuminance (88.4 lx) at the upper stage in the storage room 14, ensure the illuminance (34.2 lx), i.e., about 38.7% of the former, at the lower stage in the storage room 14. In addition, the storage container 10 according to this embodiment can provide the illuminance six times or more as much as that in the storage container 210 according to the comparative example at the lower stage in the storage room 14.

FIG. 11 depicts photographs representing the storage containers used for the comparative evaluation in this embodiment. In FIG. 11, the left photograph represents the storage container 10 according to this embodiment, and the right photograph represents the storage container 210 according to the comparative example. As seen from the photographs of FIG. 11, in the storage container 10 according to this embodiment, the storage room 14 is illuminated at such a level that the reserve substances can be visually recognized satisfactorily. On the other hand, in the storage container 210 according to the comparative example, the reserve substances are difficult to visually recognize because light does not sufficiently reach the lower stage in the storage room 14.

Figure 12A:
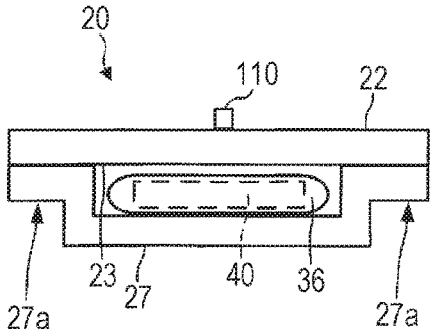
FIG. 12(*a*) is a schematic view illustrating a state where the reflectance of a shelf member 20 disposed in the storage container 10 according to the fifth embodiment of the present invention is measured, and FIG. 12(*b*) is a schematic view illustrating a state where the reflectance of a shelf member 220 disposed in the storage container 210 according to the comparative example is measured.
Figure 12B:
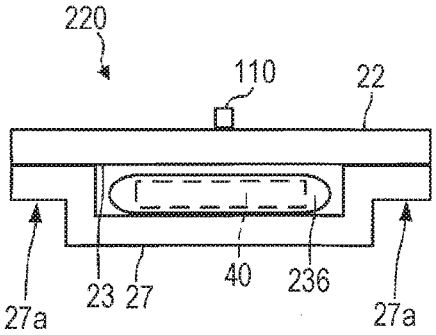

The reflectance of the shelf member 20 disposed in the storage container 10 according to this embodiment and the reflectance of the shelf member 220 disposed in the storage container 210 according to the comparative example were further measured. FIG. 12(*a*) is a schematic view illustrating a state where the reflectance of the shelf member 20 disposed in the storage container 10 according to this embodiment is measured. FIG. 12(*b*) is a schematic view illustrating a state where the reflectance of the shelf member 220 disposed in the storage container 210 according to the comparative example is measured. In each of the examples illustrated in FIGS. 12(*a*) and 12(*b*), a spectroscopic colorimeter 110 was set on the flat portion 22, and the reflectance of light with a wavelength of 550 nm was measured in terms of an SCI value. A spectroscopic colorimeter "CM-2600d" made by Konica Minolta, Inc. was used in the measurement of the reflectance.

The reflectance of the shelf member 20 disposed in the storage container 10 according to this embodiment was 22.7%. The reflectance of the shelf member 220 disposed in the storage container 210 according to the comparative example was 75.2%. Thus, in this embodiment, since the transparent film prepared by bonding nylon (with a thickness of 15 μm) and polyethylene terephthalate (with a thickness of 60 μm) is used as the packaging 36, the reflectance of the shelf member 20 is low. In the comparative example, since the aluminum film prepared by vapor-depositing the aluminum foil (with a thickness of 2 μm) and polyethylene terephthalate (with a thickness of 60 μm) is used as the packaging 36, the reflectance of the shelf member 220 is high. It is hence thought that transmittance of light transmitting through the shelf member 20 to a space thereunder is larger in the case using the transparent material as the packaging to pack the heat storage material 40 than in the case using the aluminum material as the packaging.

Figure 13:
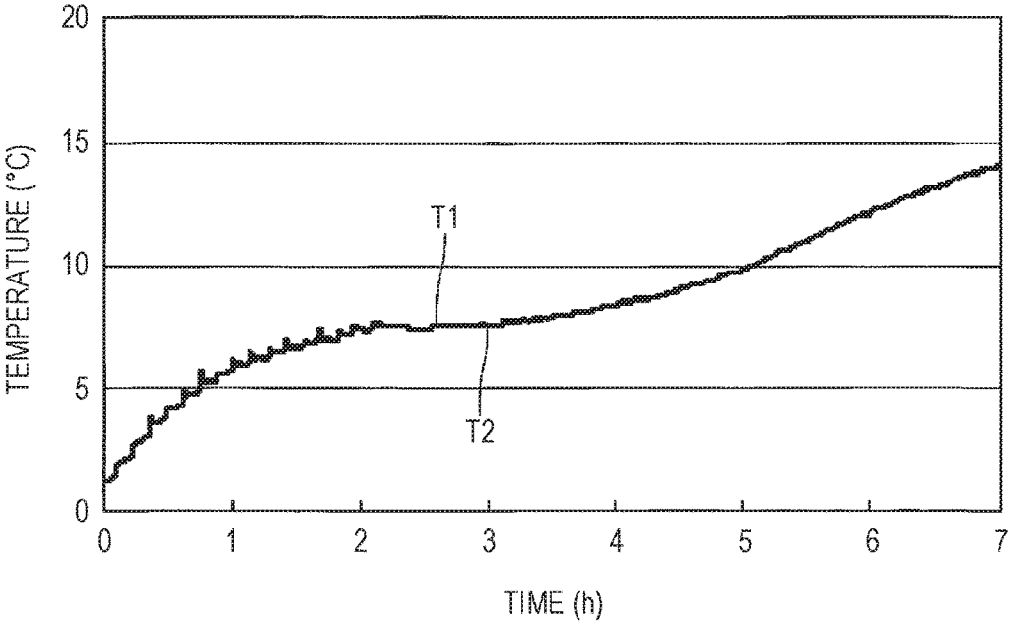
FIG. 13 is a graph plotting the measurement results of a cold keeping temperature and a cold keeping time for the storage room 14 in each of the storage container 10 according to the fifth embodiment of the present invention and the storage container 210 according to the comparative example.

The performance for keeping the storage room 14 cold after power-off of the storage container 10 according to this embodiment and the storage container 210 according to the comparative example will be described below with reference to FIG. 13. FIG. 13 plots the measurement results of a cold keeping temperature and a cold keeping time for the storage room 14 in each of the storage container 10 and the storage container 210. The horizontal axis in FIG. 13 indicates the lapsed time (h), and the vertical axis indicates the temperature (° C.) within the storage room 14. In FIG. 13, a curve T1 denoted by a solid line represents temperature change within the storage room 14 of the storage container 10 according to this embodiment, and a curve T2 denoted by a solid line represents temperature change within the storage room 14 of the storage container 10 according to the comparative example.

In this case, the cold keeping temperature and the cold keeping time for the storage room 14 were measured for each of the storage container 10 and the storage container 210 under the same conditions except for the packaging used to pack the heat storage material 40. More specifically, 900 g of paraffin (tetradecane) was used as the heat storage material 40. The heat storage material 40 was packed in units of 150 g, and two packs were arranged at each of the ceiling (upper inner wall) of the storage room 14, the upper stage in the storage room 14, and the lower stage in the storage room 14. The opening/closing door 16 was opened 16 times at intervals of 8 min. An opening time per opening of the opening/closing door 16 was set to 15 sec. Three plastic (PET) bottles each having a volume of 500 mL and filled with 500 mL of water were placed in the storage room 14. The temperature in an installed place of the storage containers 10 and 210 was set to 30° C.

As seen from FIG. 13, substantially the same measurement results are obtained with the storage container 10 according to this embodiment and the storage container 210 according to the comparative example. In each of the storage container 10 and the storage room 210, the temperature within the storage room 14 can be kept at 10° C. or below for 5 hours or longer. It is hence understood that there is no difference in the cold keeping performance for the storage room 14 between the case using, as the packaging for the heat storage material 40, the transparent film prepared by bonding nylon (with a thickness of 15 μm) and polyethylene terephthalate (with a thickness of 60 μm) and the case using, as the packaging, the aluminum film prepared by vapor-depositing the aluminum foil (with a thickness of 2 v) and polyethylene terephthalate (with a thickness of 60 v).

Dependency of optical characteristics of heat storage materials on film thickness will be described below with reference to FIGS. 14 and 15. In this case, three different types of substances were used as the heat storage materials. Furthermore, three heat storage materials having different thicknesses were fabricated by employing each of the three substances. The reflectances of each heat storage material in the solid state and in the liquid phase state were measured.

Figures 14, 15:
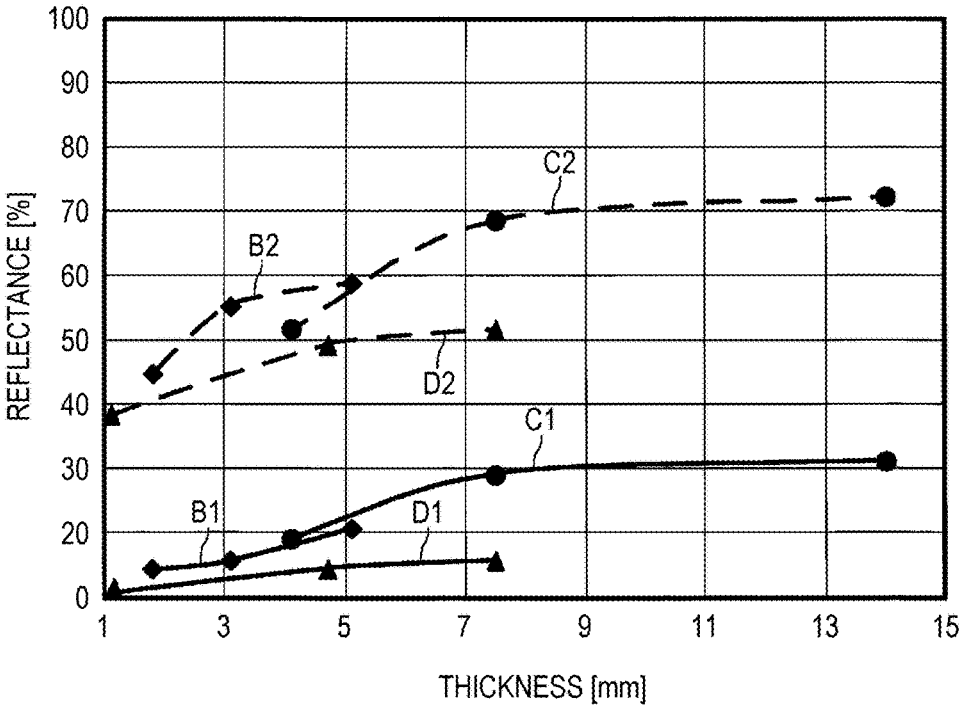
FIG. 14 is a table indicating dependency, on film thickness, of optical characteristics of heat storage materials used in the storage container according to the fifth embodiment of the present invention.
FIG. 15 is a graph plotting the dependency, on film thickness, of the optical characteristics of the heat storage materials used in the storage container according to the fifth embodiment of the present invention.

FIG. 14 is a table indicating dependency of optical characteristics of the heat storage materials 40 on the film thickness. The item "Substance" in FIG. 14 indicates a latent heat storage substance used as the heat storage material 40.

The item "Paraffin-Based Substance 1" in FIG. 14 indicates the dependency of optical characteristics of the heat storage materials 40 on the film thickness in the case using a substance prepared by gelling tetradecane with polybutadiene. The fabricated three heat storage materials 40 were packed with the packagings to have thicknesses of 1.8 mm, 3.1 mm and 5.1 mm including the packagings. The item "Paraffin-Based Substance 2" in FIG. 14 indicates the dependency of optical characteristics of the heat storage materials 40 on the film thickness in the case using a substance prepared by gelling dodecane with polybutadiene. The fabricated three heat storage materials 40 were packed with the packagings to have thicknesses of 4.1 mm, 7.5 mm and 14 mm including the packagings. The item "Hydrate-Based Substance" in FIG. 14 indicates the dependency of optical characteristics of the heat storage materials 40 on the film thickness in the case using a substance prepared by gelling an aqueous solution (ammonium chloride: 8 wt % and potassium chloride: 8 wt %), resulting from dissolving ammonium chloride and potassium chloride in water, with acrylamide and gelatin (acrylamide: 0.7 wt % and gelatin 0.4 wt %). The fabricated three heat storage materials 40 were packed with the packagings to have thicknesses of 1.1 mm, 4.7 mm and 7.5 mm including the packagings.

A silica-deposited film prepared by vapor-depositing silica over a surface of polyethylene terephthalate was used as the packaging 36 for the heat storage material 40. The silica-deposited film had a thickness of 12 μm and a total optical transmittance of 89%.

The item "Reflectance (%)" in FIG. 14 is divided into the items "Liquid Phase State" and "Solid State". The item "Liquid Phase State" in FIG. 14 indicates the reflectance of each heat storage material 40 in the liquid phase state. The item "Solid State" in FIG. 14 indicates the reflectance of each heat storage material in the solid state. As seen from FIG. 14, the heat storage material 40 made of the Paraffin-Based Substance 1 and having the thickness of 1.8 mm has the reflectance of 14.4% in the liquid phase state and the reflectance of 44.9% in the solid state. The heat storage material 40 made of the Paraffin-Based Substance 1 and having the thickness of 3.1 mm has the reflectance of 15.8% in the liquid phase state and the reflectance of 55.3% in the solid state. The heat storage material 40 made of the Paraffin-Based Substance 1 and having the thickness of 5.1 mm has the reflectance of 20.8% in the liquid phase state and the reflectance of 59.0% in the solid state. The heat storage material 40 made of the Paraffin-Based Substance 2 and having the thickness of 4.1 mm has the reflectance of 19.2% in the liquid phase state and the reflectance of 51.9% in the solid state. The heat storage material 40 made of the Paraffin-Based Substance 2 and having the thickness of 7.5 mm has the reflectance of 29.1% in the liquid phase state and the reflectance of 68.7% in the solid state. The heat storage material 40 made of the Paraffin-Based Substance 3 and having the thickness of 14 mm has the reflectance of 31.3% in the liquid phase state and the reflectance of 72.4% in the solid state. The heat storage material 40 made of the Hydrate-Based Substance and having the thickness of 1.1 mm has the reflectance of 10.5% in the liquid phase state and the reflectance of 38.6% in the solid state. The heat storage material 40 made of the Hydrate-Based Substance and having the thickness of 4.7 mm has the reflectance of 14.4% in the liquid phase state and the reflectance of 49.2% in the solid state. The heat storage material 40 made of the Hydrate-Based Substance and having the thickness of 7.5 mm has the reflectance of 15.8% in the liquid phase state and the reflectance of 51.9% in the solid state.

FIG. 15 is a graph plotting dependency of optical characteristics of the heat storage materials 40, indicated in the table of FIG. 14, on the film thickness. The horizontal axis in FIG. 15 indicates the thickness (mm) of the heat storage material 40, and the vertical axis indicates the reflectance (%) of the heat storage material 40. In FIG. 15, a curve B1 denoted by a solid line represents the dependency of optical characteristics of the Paraffin-Based Substance 1 in the liquid phase state on the film thickness. A curve B2 denoted by a dotted line represents the dependency of optical characteristics of the Paraffin-Based Substance 1 in the solid state on the film thickness. A curve C1 denoted by a solid line represents the dependency of optical characteristics of the Paraffin-Based Substance 2 in the liquid phase state on the film thickness. A curve C2 denoted by a dotted line represents the dependency of optical characteristics of the Paraffin-Based Substance 2 in the solid state on the film thickness. A curve D1 denoted by a solid line represents the dependency of optical characteristics of the Hydrate-Based Substance in the liquid phase state on the film thickness. A curve D2 denoted by a dotted line represents the dependency of optical characteristics of the Hydrate-Based Substance in the solid state on the film thickness.

As seen from FIGS. 14 and 15, the reflectance of the heat storage material 40 is higher in the solid state than in the liquid phase state regardless of using any type of substance. It is hence understood that the transparency of the heat storage material 40 is lower in the solid state than in the liquid phase state. Furthermore, regardless of being in the liquid phase state or the solid state, the reflectance of the heat storage material 40 increases as the thickness increases. It is hence understood that the transparency of the heat storage material 40 is lower as the thickness increases. From the above-discussed points, it is understood that the thickness of the heat storage material 40 held by the shelf member 20 preferably has a smaller thickness from the viewpoint of ensuring satisfactory illuminance at the middle stage and the lower stage in the storage room 14.

The storage container 10 according to this embodiment includes the shelf member 20, which has optical transparency, and which includes the flat portion 22 and the heat storage material 40 arranged adjacent to the flat portion 22. The heat storage materials 40 made of the Paraffin-Based Substance 1, the Paraffin-Based Substance 2, and Hydrate-Based Substance have optical transparency. Thus, since the light from the storage room lamp 34 for illuminating the interior of the storage room 14 is not blocked by the heat storage material 40 arranged to the shelf member 20, reduction of the illuminance in the space under the heat storage material 40 can be prevented. Moreover, since an increase in the thickness of the shelf member 20 including the heat storage material 40 can be reduced, the storage volume is not sacrificed.

Sixth Embodiment

Figure 16:
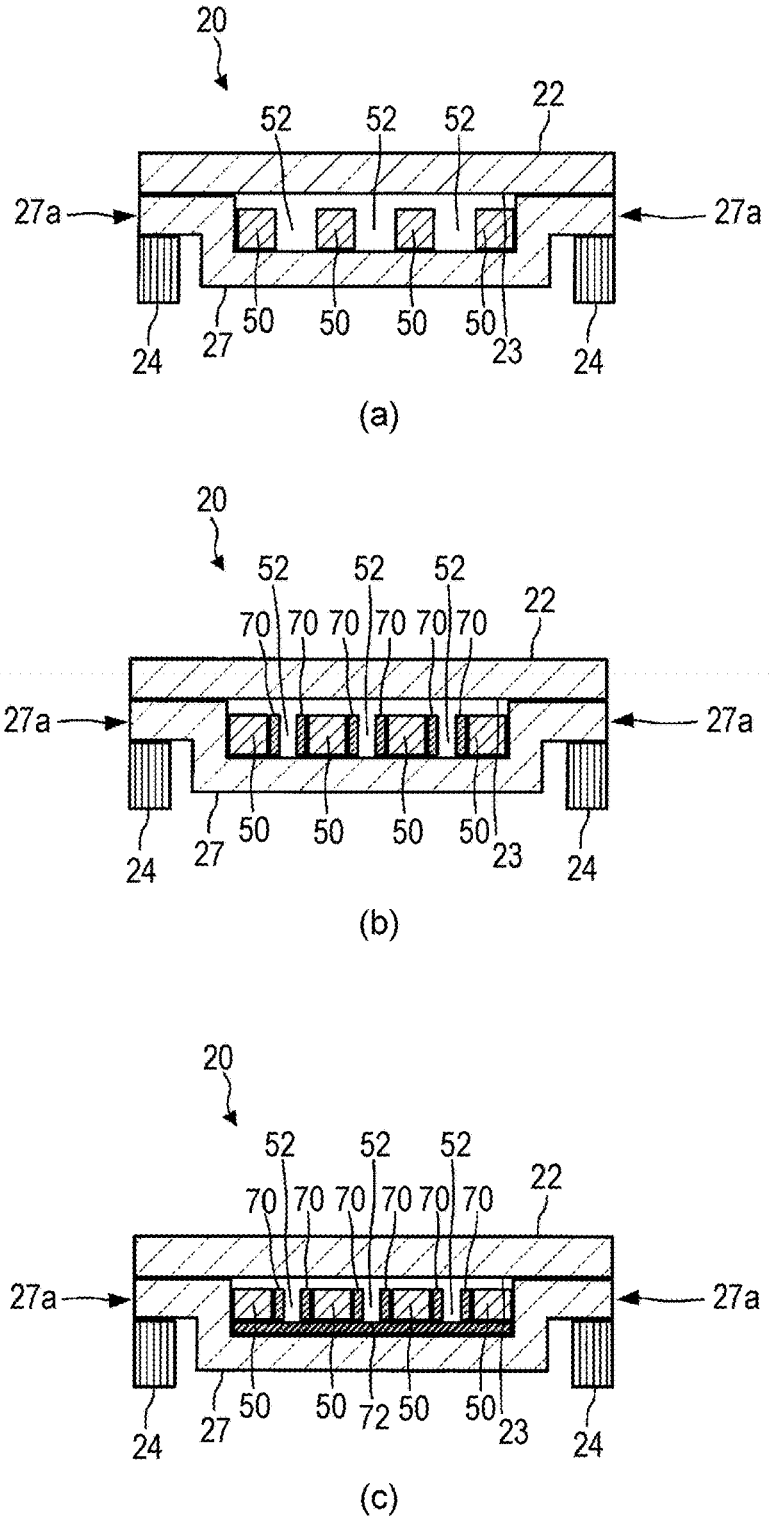
FIG. 16 is a sectional view when looking at shelf members 20, which are mounted to shelf supporters 24 in a storage container according to a sixth embodiment of the present invention, from the front of the storage container.

A storage container 10 according to a sixth embodiment of the present invention will be described below with reference to FIG. 16. It is to be noted that components having the same functions and operating in the same manners as those in the above embodiments are denoted by the same reference signs, and description of those components is omitted. FIGS. 16(*a*) to 16(*c*) are each a sectional view when looking at shelf members 20, which are mounted to shelf supporters 24, from the front of the storage container.

In an example illustrated in FIG. 16(*a*), the shelf member 20 includes a heat storage material 50 having a plurality of openings 52. Thus, since the storage container includes the heat storage material 50 having the plurality of openings 52, the illumination light from the storage room lamp 34 can pass through the openings 53 and reach a space under the shelf member 20 without being blocked off by the shelf member 20.

In an example illustrated in FIG. 16(*b*), the heat storage material 50 includes light reflecting films 70 that have optical reflectivity, and that are coated over lateral surfaces defining the openings 52. Thus, since the storage container includes the light reflecting films 70 over the lateral surfaces defining the openings 52, the optical transparency of the shelf member 20 can be improved.

In an example illustrated in FIG. 16(*c*), the shelf member 20 includes a light-diffusing transparent film 72 that is disposed under the heat storage material 50, and that has light-diffusing transparency. Thus, since the storage container includes the light-diffusing transparent film 72 arranged between the openings 52 and a bottom surface of the tray 27, the illumination light from the storage room lamp 34 can be uniformly diffused into the space under the shelf member 20.

Thus, in the storage container including the shelf member 20 illustrated in each of FIGS. 16(*a*) to 16(*c*), sufficient illuminance can be obtained under the shelf member 20.

Seventh Embodiment

A storage container 10 according to a seventh embodiment of the present invention will be described below with reference to FIGS. 17 to 20. It is to be noted that components having the same functions and operating in the same manners as those in the above embodiments are denoted by the same reference signs, and description of those components is omitted.

Figure 17:
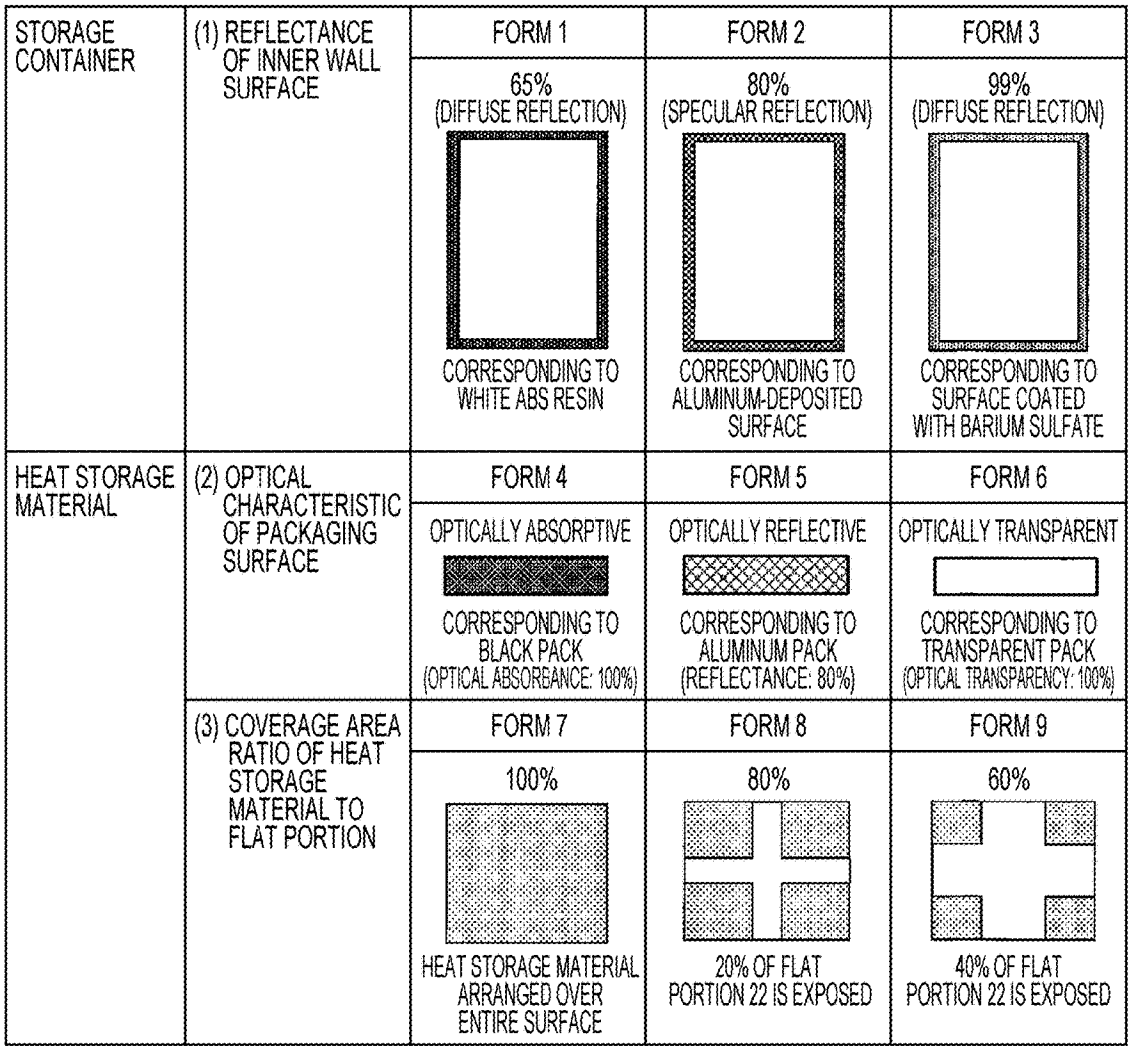
FIG. 17 is a table indicating configurations of a storage container 10 used in optical simulations in a seventh embodiment of the present invention.

In this embodiment, a calculation model of the storage container 10 was prepared, and the illuminance in the storage room 14 illuminated by the light from the storage room lamp 34 was calculated with an optical simulation. FIG. 17 indicates configurations of the storage container 10 used in optical simulations in this embodiment.

In this embodiment, the optical simulations were performed on condition that the reflectance of an inner wall surface of the storage room 14 was classified into three types, i.e., Forms 1 to 3. In Form 1, reflection at the inner wall surface was diffuse reflection, and the reflectance of the inner wall surface was 66%. The reflectance of the inner wall surface in Form 1 corresponds to that of a white ABS resin. In Form 2, reflection at the inner wall surface was specular reflection, and the reflectance of the inner wall surface was 80%. The reflectance of the inner wall surface in Form 2 corresponds to that of an aluminum-deposited inner wall. In Form 3, reflection of the inner wall surface was diffuse reflection, and the reflectance of the inner wall surface was 99%. The reflectance of the inner wall surface in Form 3 corresponds to that of an inner wall coated with barium sulfate.

Furthermore, in this embodiment, the optical simulations were performed on condition that the packaging 36 for the heat storage material 40 was classified into three types, i.e., Forms 4 to 6. In Form 4, the packaging 36 was optically absorptive with an optical absorbance of 100%. The packaging 36 in Form 4 corresponds to a black pack. In Form 5, the packaging 36 was optically reflective with a reflectance of 80%. The packaging 36 in Form 5 corresponds to an aluminum pack. In Form 6, the packaging 36 was optically transparent with an optical transparency of 100%. The packaging 36 in Form 6 corresponds to a transparent pack.

Moreover, in this embodiment, the optical simulations were performed on condition that the heat storage material was arranged at the rear surface 23 of the flat portion 22 of the shelf member 20 and a coverage area ratio of the heat storage material 40 to the flat portion 22 was classified into three types, i.e., Forms 7 to 9. In Form 7, the coverage area ratio of the heat storage material to the flat portion 22 was 100%. When observing the shelf member 20 from the side including the rear surface 23 in Form 7, the heat storage material 40 was arranged over the entire rear surface 23. In Form 8, the coverage area ratio of the heat storage material to the flat portion 22 was 80%. When observing the shelf member 20 from the side including the rear surface 23 in Form 8, 20% of the flat portion 22 was exposed. In Form 9, the coverage area ratio of the heat storage material to the flat portion 22 was 60%. When observing the shelf member 20 from the side including the rear surface 23 in Form 9, 40% of the flat portion 22 was exposed.

Figure 18:
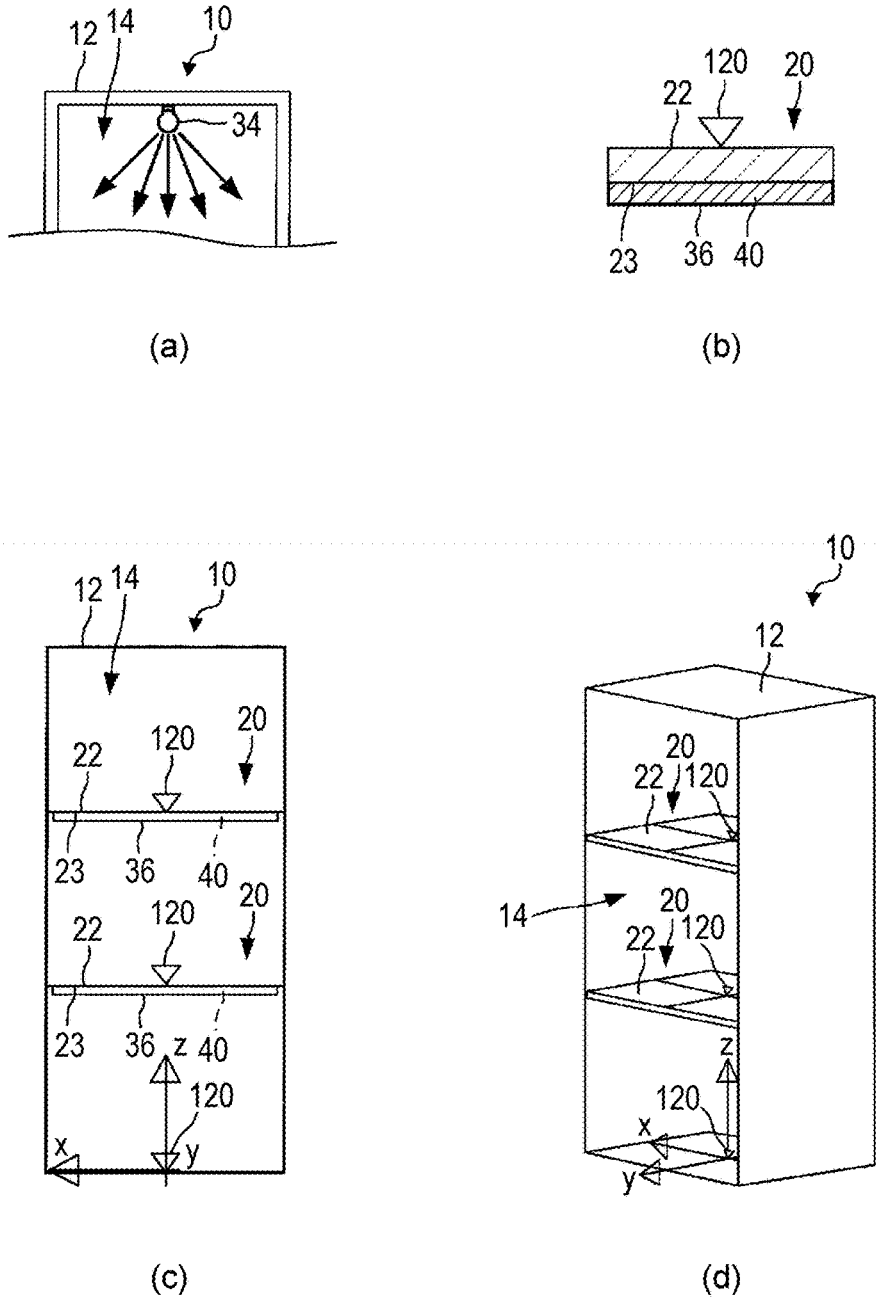
FIG. 18 illustrates calculation models for the storage container 10 used in the optical simulations in the seventh embodiment of the present invention.

FIG. 18 illustrates calculation models used in the optical simulations in this embodiment. FIG. 18(*a*) schematically illustrates a calculation model for the storage room lamp 34. As illustrated in FIG. 18(*a*), the storage room lamp 34 is disposed at the upper inner wall (ceiling) of the storage room 14. In FIG. 18(*a*), arrows extending from the storage room lamp 34 imaginarily denote light emitted from the storage room lamp 34.

FIG. 18(*b*) illustrates a calculation model for the shelf member 20. In the optical simulations in this embodiment, an optical receiver 120 was disposed at the center of the flat portion 22.

FIG. 18(*c*) illustrates a calculation model when looking at the storage container 10 from the front. FIG. 18(*d*) illustrates a calculation model when looking the storage container 10 from the obliquely upper side. As illustrated in FIGS. 18(*c*) and 18(*d*), an illuminance value at the upper stage in the storage room was determined with the optical receiver 120 disposed on the flat portion 22 of the shelf member 20 that was arranged in the upper portion of the storage room 14. An illuminance value at the middle stage in the storage room was determined with the optical receiver 120 disposed on the flat portion 22 of the shelf member 20 that was arranged in the lower portion of the storage room 14. An illuminance value at the lower stage in the storage room was determined with the optical receiver 120 disposed on the bottom surface of the storage room 14.

FIG. 19 indicates calculation conditions of the calculation models, which are used as an evaluation reference for the optical simulations. As illustrated in FIG. 19, the dimensions (internal) of the storage room of the storage container were set to a width of 400 mm, a depth of 300 mm, and a height of 900 mm. The reflectance of the inner wall surface of the storage room was set to 65% (diffuse reflection (measured value of ABS resin)) (Form 1 illustrated in FIG. 17). The external dimensions of a shelf plate were set to a width of 380 mm, a depth of 280 mm, and a height of 13 mm. A material of the shelf plate was glass. The luminous flux of the illumination light from the storage room lamp 34 was set to 100 lumen, the wavelength of the illumination light was set to 550 nm, and distribution of the illumination light was set to isotropic illumination. Furthermore, the optical characteristic of the packaging 36 was set to be optically absorptive (absorbance of 100%) (Form 4 illustrated in FIG. 17). In addition, the coverage area ratio of the heat storage material to the flat portion was set to 100% (Form 7 illustrated in FIG. 17).

The illuminance value was calculated with the above conditions being an evaluation reference. Moreover, effects in improvement of the illuminance relative to the evaluation reference were evaluated while the reflectance of the inner wall surface was changed to each of Forms 1 to 3 illustrated in FIG. 17, the optical characteristic of the surface of the packaging 36 was changed to each of Forms 4 to 6 illustrated in FIG. 17, and the coverage area ratio of the heat storage material 40 to the flat portion 22 was changed to each of Forms 7 to 9 illustrated in FIG. 17.

FIG. 20 indicates the results of the optical simulations in this embodiment. The combination of Form 1, Form 4, and Form 7 represents the simulation results for the evaluation reference. As indicated in FIG. 20, the illuminance in the storage room 14 was 229.1 lx at the upper stage in the storage room 14, 1.4 lx at the middle stage in the storage room 14, and 0.0 lx at the lower stage in the storage room 14. Assuming the illuminance at the upper stage in the storage room 14 to be a reference (100%), the illuminance at the middle stage in the storage room 14 was 0.6%, and the illuminance at the lower stage in the storage room 14 was 0.0%.

With the optical simulation in the combination of Form 1, Form 5, and Form 7, the illuminance in the storage room 14 was 442.6 lx at the upper stage in the storage room 14, 4.1 lx at the middle stage in the storage room 14, and 0.1 lx at the lower stage in the storage room 14. Assuming the illuminance at the upper stage in the storage room 14 to be a reference (100%), the illuminance at the middle stage in the storage room 14 was 0.9%, and the illuminance at the lower stage in the storage room 14 was 0.0%.

With the optical simulation in the combination of Form 1, Form 6, and Form 7, the illuminance in the storage room 14 was 250.5 lx at the upper stage in the storage room 14, 90.0 lx at the middle stage in the storage room 14, and 56.5 lx at the lower stage in the storage room 14. Assuming the illuminance at the upper stage in the storage room 14 to be a reference (100%), the illuminance at the middle stage in the storage room 14 was 35.9%, and the illuminance at the lower stage in the storage room 14 was 22.6%.

With the optical simulation in the combination of Form 1, Form 4, and Form 8, the illuminance in the storage room 14 was 230.7 lx at the upper stage in the storage room 14, 29.7 lx at the middle stage in the storage room 14, and 15.1 lx at the lower stage in the storage room 14. Assuming the illuminance at the upper stage in the storage room 14 to be a reference (100%), the illuminance at the middle stage in the storage room 14 was 12.9%, and the illuminance at the lower stage in the storage room 14 was 6.5%.

With the optical simulation in the combination of Form 1, Form 4, and Form 9, the illuminance in the storage room 14 was 234.7 lx at the upper stage in the storage room 14, 53.4 lx at the middle stage in the storage room 14, and 29.9 lx at the lower stage in the storage room 14. Assuming the illuminance at the upper stage in the storage room 14 to be a reference (100%), the illuminance at the middle stage in the storage room 14 was 22.7%, and the illuminance at the lower stage in the storage room 14 was 12.7%.

With the optical simulation in the combination of Form 2, Form 6, and Form 7, the illuminance in the storage room 14 was 505.4 lx at the upper stage in the storage room 14, 223.6 lx at the middle stage in the storage room 14, and 184.3 lx at the lower stage in the storage room 14. Assuming the illuminance at the upper stage in the storage room 14 to be a reference (100%), the illuminance at the middle stage in the storage room 14 was 44.2%, and the illuminance at the lower stage in the storage room 14 was 36.5%.

With the optical simulation in the combination of Form 3, Form 6, and Form 7, the illuminance in the storage room 14 was 322.8 lx at the upper stage in the storage room 14, 187.0 lx at the middle stage in the storage room 14, and 145.8 lx at the lower stage in the storage room 14. Assuming the illuminance at the upper stage in the storage room 14 to be a reference (100%), the illuminance at the middle stage in the storage room 14 was 57.9%, and the illuminance at the lower stage in the storage room 14 was 45.2%.

In general, the illuminance in a refrigerator is regarded as satisfactory at 50 lx or more. As seen from FIG. 20, the result of the optical simulation for the storage container 10 in the combination of Form 1, Form 6, and Form 7 provides the illuminance of 250.5 lx at the upper stage in the storage room 14, 90.0 lx at the middle stage in the storage room 14, and 56.6 lx at the lower stage in the storage room 14. Thus, in the storage container 10 in the combination of Form 1, Form 6, and Form 7, the illuminance of 50 lx or more can be obtained in the storage room 14.

The result of the optical simulation for the storage container 10 in the combination of Form 2, Form 6, and Form 7 provides the illuminance of 505.4 lx at the upper stage in the storage room 14, 223.6 lx at the middle stage in the storage room 14, and 184.3 lx at the lower stage in the storage room 14. Thus, in the storage container 10 in the combination of Form 2, Form 6, and Form 7, the illuminance of 180 lx or more can be obtained in the storage room 14.

The result of the optical simulation for the storage container 10 in the combination of Form 3, Form 6, and Form 7 provides the illuminance of 322.8 lx at the upper stage in the storage room 14, 187.0 lx at the middle stage in the storage room 14, and 145.8 lx at the lower stage in the storage room 14. Thus, in the storage container 10 in the combination of Form 3, Form 6, and Form 7, the illuminance of 140 lx or more can be obtained in the storage room 14.

Eighth Embodiment

Figure 22:
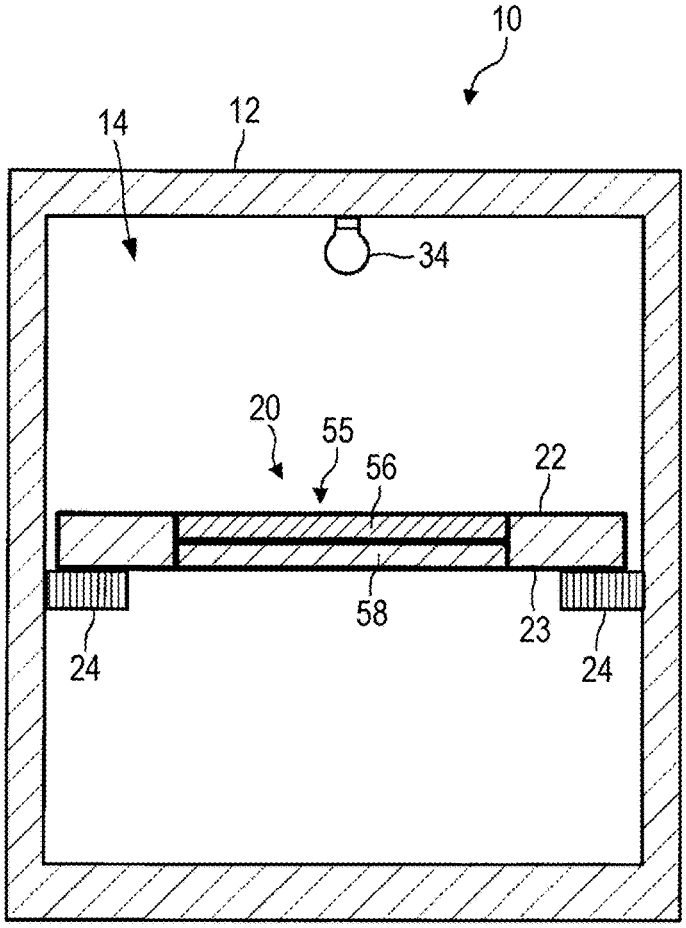
FIG. 22 is a sectional view of a storage container 10 according to a modification of the eighth embodiment of the present invention when looking at the storage container 10 from the front.

A storage container according to an eighth embodiment of the present invention will be described below with reference to FIGS. 21 to 23. It is to be noted that components having the same functions and operating in the same manners as those in the above embodiments are denoted by the same reference signs, and description of those components is omitted.

FIG. 21(*a*) illustrates a state when looking at a flat portion 22, from a normal direction, of a shelf member 20 in a storage container according to this embodiment. The shelf member 20 includes the flat portion 22 and a plurality of heat storage materials 54 discretely arranged at predetermined intervals. As illustrated in FIG. 22(*a*), the plural heat storage materials 54 are arranged in a matrix pattern of 4 rows and 5 columns. Looking at the flat portion 22 from the normal direction, each heat storage material 54 has a circular shape. For example, paraffin, an inorganic salt aqueous solution, or an inorganic salt hydrate is used as the heat storage material 54. The heat storage material 54 is in a gel state. The heat storage material 54 may be packed with a packaging.

FIG. 21(*b*) is a sectional view of the shelf member 20 cut along a line B-B in FIG. 21. As illustrated in FIG. 21(*b*), the flat portion 22 includes a plurality of bowl-shaped recesses 74. The recesses 74 are arranged in a matrix pattern of 4 rows and 5 columns when looking at the flat portion 22 from the normal direction. The heat storage materials 54 are arranged respectively in the recesses 74.

Thus, in the storage container according to this embodiment, since the heat storage materials 54 are arranged respectively in the recesses 74, the heat storage materials 54 can be fixed reliably. Furthermore, the flat portion 22 is made of transparent resin or glass, and hence the flat portion 22 has optical transparency. As illustrated in FIG. 21(*a*), the storage container includes the heat storage materials 54 arranged at the predetermined intervals, and the illumination light from the storage room lamp 34 are able to pass through regions of the flat portion 22 where the heat storage materials 54 are not arranged when looking at the flat portion 22 from the normal direction. In the storage container according to this embodiment, therefore, sufficient illuminance can be obtained under the shelf member 20.

Modification

A storage container 10 according to a modification of this embodiment will be described below with reference to FIGS. 22 and 23. FIG. 22 is a sectional view illustrating a configuration of the storage container 10 according to this modification when looking at the storage container from the front. The storage container 10 according to this modification includes a heat storage material 55 arranged inside the flat portion 22. The heat storage material 55 includes a plurality of latent heat storage substances 56 and 58. In other words, the heat storage material 55 has layered structure in which the latent heat storage substances 56 and 58 are stacked one above the other. The latent heat storage substance 56 is arranged in the flat portion 22 at the side closer to its front surface. The latent heat storage substance 58 is arranged in the flat portion 22 at the side closer to its rear surface 23.

For example, when the storage container 10 is a refrigerator of the indirect cooling type, a supply opening of cold air for cooling the storage room 14 is disposed at the upper rear side in the storage room 14. In another example, when the storage container 10 is a refrigerator of the direct cooling type, a cooler is disposed at the rear side in the storage room 14. In the storage room 14, therefore, the temperature within in the storage room 14 is relatively lower in a space above the front surface of the flat portion 22, and is relatively higher in a space under the rear surface 23 of the flat portion 22.

In the case of, e.g., a refrigerator of the direct cooling type including a cooler in an upper portion of the storage room 14 and having an inner volume of about 160 liters, an average temperature above the shelf member 20 disposed in a central portion (i.e., an average temperature at the side where the cooler is installed) is about −8° C., while an average temperature under the shelf member 20 is about 4° C. In that case, for example, potassium hydrogencarbonate (phase change temperature: about −6° C.) is used as the latent heat storage substance 56 that is arranged in the flat portion 22 at the side closer to its front surface. For example, tetradecane (phase change temperature: about 6° C.) is used as the latent heat storage substance 58 that is arranged in the flat portion 22 at the side closer to its rear surface 23.

Moreover, the front surface of the flat portion 22 receives cold air produced by the cooler. During steady operation of the storage container 10, therefore, the latent heat storage substances 56 and 58 are cooled from the front surface side of the flat portion 22. The front surface of the flat portion 22 is formed of a material having a relatively high thermal conductivity. Accordingly, in the storage container 10, the latent heat storage substances 56 and 58 can be cooled and solidified in a short time.

When the operation of the cooling mechanism is stopped upon, e.g., power outage, convection occurs in the storage room 14 such that air at relatively high temperature ascends and air at relatively low temperature descends. Thus, the air at relatively high temperature ascends to the vicinity of the rear surface 23. At the rear surface 23, therefore, heat exchange is performed between the latent heat storage substance 58 and the air near the rear surface 23. The rear surface 23 at which the heat exchange is performed is made of a material having a relatively low thermal conductivity. As a result, the storage container 10 is able to prolong a time during which cold energy is released from the latent heat storage substance 58, and to prolong a cold keeping time in the storage room 14.

Layout examples of the heat storage material 55 mounted to the flat portion 22 of the shelf member 20 in the storage container 10 according to this embodiment will be described below with reference to FIG. 23. As in the embodiment illustrated in FIG. 21, the heat storage material 55 is arranged in each of recesses formed in the flat portion 22. FIGS. 23(*a*) and 23(*b*) illustrate a state when looking at the flat portion 22 of the shelf member 20 from a normal direction.

In an example illustrated in FIG. 23(*a*), the heat storage material 55 has a trapezoidal shape when looking at the flat portion 22 from the normal direction. The trapezoidal shape of the heat storage material 55 has two legs in different lengths. Therefore, the trapezoidal shape is left-right asymmetric when looking at the flat portion 22 from the normal direction.

In an example illustrated in FIG. 23(*b*), the heat storage material 55 has a combined shape of a semicircle and a trapezoid when looking at the flat portion 22 from the normal direction. Such a shape is left-right asymmetric when looking at the flat portion 22 from the normal direction.

For example, when the heat storage material 55 has a layered structure in which plural latent heat storage substances 56 and 58 are stacked one above the other, the orientation of the heat storage material 55 in the up and down direction is uniquely determined when the heat storage material 55 is mounted to the flat portion 22. Thus, since the storage container 10 includes the heat storage material in a left-right asymmetric shape when looking at the flat portion 22 from the normal direction, it is possible to prevent false mounting of the heat storage material 55 to the flat portion 22, such as mounting of the heat storage material 55 to the shelf member 20 in false orientation in the up and down direction.

In the storage container 10 according to this embodiment, regions of the flat portion 22 where the heat storage material 54 is not arranged when looking at the flat portion 22 from the normal direction have optical transparency. The flat portion 22 is made of transparent glass, for example. Thus, since the shelf member 20 allows the light from the storage room lamp 34 for illuminating the interior of the storage room 14 to pass therethrough, reduction of the illuminance in a space under the heat storage material 40 can be prevented.

The present invention is not limited to the above embodiments, and the present invention can be variously modified.

While the above embodiments have been described in connection with the refrigerator as one example of the storage container, the present invention is not limited to that example and is applicable to a freezer and a heating cabinet as well.

According to Standard No. C9801 of JIS (Japan Industrial Standards), in determining an inner volume of a refrigerator, the inner volume is determined on an assumption that a shelf (shelf member) and a partition disposed within the refrigerator and each having a thickness of less than 13 mm is regarded to be not present. In the above embodiments, the thickness of the transparent glass used as the flat portion 22 is 4 mm, for example. In the case of arranging the heat storage material 40 at the rear surface 23, therefore, reduction of the inner volume, specified in the JIS standard, of the storage container 10 attributable to the provision of the heat storage material 40 can be avoided by setting the thickness of the heat storage material 40 to be less than 9 mm such that a total thickness of the shelf member 20 is kept less than 13 mm. In the case of arranging the heat storage material 40 on the tray 27, the reduction of the inner volume, specified in the JIS standard, of the storage container 10 attributable to the provision of the heat storage material can be avoided by setting the thickness of the tray to be less than 9 mm such that a total thickness of the shelf member 20 is held less than 13 mm. Furthermore, when the heat storage material is formed in a smaller thickness, optical transparency of the shelf member 20 is increased as described above. Thus, the interior of the storage room 14 can be kept lit because the shelf member does not block off the light from the storage room lamp 34 for illuminating the interior of the storage room 14.

While, in the above embodiments, a transparent material is used as the packaging 36, a semitransparent material may be used as the packaging 36. The packaging 36 may have the light storage function. In that case, the packaging 36 is able to store light of illumination, for example, in the installed place of the storage container (e.g., illumination in a living space), and to emit light when the illuminance in the installed place of the storage container is not sufficient, such as at the night, to prevent reduction of the illuminance in the storage room 14.

The heat storage material may contain an aromatic, e.g., tertiary-butylmercaptan or tetrahydrothiophenone. In that case, if the packaging 36 is broken, the heat storage material releases an odor of the aromatic to the outside of the packaging 36, thereby making leakage of the heat storage material from the packaging 36 noticeable by the user of the storage container. In the storage container in which a seal reacting with an odor component of the aromatic contained in the heat storage material and changing its color is disposed within the storage room 14, the user can visually recognize the leakage of the heat storage material from the packaging 36 upon finding change in the color of the seal. Preferably, the odor component of the aromatic naturally disappears (gives out) with the lapse of time such that the odor will not attach to the reserve substances and so on.

Alternatively, the heat storage material may be dyed in a fluorescent color to make the user easily recognize the leakage of the heat storage material from the packaging 36 in the event that the packaging 36 is broken.

The fluorescent material used for dyeing is preferably a material having an emission peak wavelength of 600 nm or more. By illuminating meats, tuna, etc. with light having a wavelength of 600 nm or more, redness of those reserves can be emphasized, thus enabling foods within the refrigerator to appear fresher and more delicious. Examples of the fluorescent material are described below, but fluorescent materials usable in the present invention are not limited to the following examples.

Examples of organic fluorescent materials include, as red fluorescent dyes for converting ultraviolet or blue excitation light to red luminescence, cyanine dyes: 4-dicyanomethylene-2-methyl-6-(p-dimethylaminostylryl)-4H-pyran, pyridine dyes: 1-ethyl-2-[4-(p-dimethylaminophenyl)-1,3-butadienyl]-pyridinium-perchlorate (Pyridine 1), xanthene dyes: Rhodamine B, Rhodamine 6G, Rhodamine 3B, Rhodamine 101, Rhodamine 110, Basic Violet 11, Sulforhodamine 101, Basic Violet 11, and Basic Red 2, perylene dyes: Lumogen Orange, Lumogen Pink, Lumogen Red, and Solvent Orange 55, oxazine dyes, chrysene dyes, thioflavine dyes, pyren dyes, anthracene dyes, acridone dyes, acrydine dyes, fluorene dyes, ter-phenyl dyes, ethene dyes, butadiene dyes, hexatriene dyes, oxazole dyes, coumarin dyes, stilbene dyes, diphenylmethane dyes, triphenylmethane dyes, thiazole dyes, thiazine dyes, naphthalimide dyes, and anthraquinone dyes.

Examples of inorganic fluorescent materials include, as red fluorescent dyes for converting ultraviolet or blue excitation light to red luminescence, $Y_2O_2S:Eu^{3+}$, $YAlO_3:Eu^{3+}$, $Ca_2Y_2(SiO_4)_6:Eu^{3+}$, $LiY_9(SiO_4)_6O_2:Eu^{3+}$, $YVO_4:Eu^{3+}$, $CaS:Eu^{3+}$, $Gd_2O_3:Eu^{3+}$, $Gd_2O_2S:Eu^{3+}$, $Y(P,V)O_4:Eu^{3+}$, $Mg_4GeO_{5.5}F:Mn^{4+}$, $Mg_4GeO_6:Mn^{4+}$, $K_5Eu_{2.5}(WO_4)_{6.25}$, $Na_5Eu_{2.5}(WO_4)_{6.25}$, $K_5Eu_{2.5}(MoO_4)_{6.25}$, and $Na_5Eu_{2.5}(MoO_4)_{6.25}$.

Temperature indicating ink or temperature sensitive ink, each changing a color at predetermined temperature, may be used for the dyeing. Whether the interior of the refrigerator is cooled or not can be easily recognized from coloration of the heat storage material, for example, by arranging, in the refrigerator, the heat storage material mixed with the temperature indicating ink (e.g., Temperature Indicating Ink "Temperature Type: 15" made by Kuboi Ink Co., Ltd.), which is able to reversibly change a color between a colorless state and blue at about 10° C. When the heat storage material is packed with a packaging, the above-mentioned ink may be printed on the packaging, instead of being printed on the heat storage material, by screen printing, gravure printing, hot stamping, or the like.

In general, a door pocket is formed in an opening/closing door of a refrigerator. The heat storage material may be arranged in the door pocket. In a storage container including the heat storage material arranged in the door pocket, the door pocket can be partially kept cold.

It is to be noted that the matters explained in the above detailed description, particularly the matters explained in the above embodiments, can be optionally combined with each other.

The storage containers according to the above embodiments are expressed, by way of example, as follows.

Appendix 1

A storage container that preserves an object at predetermined temperature, the storage container comprising:

a storage room 14 in which the object is preserved; and a shelf member 20 disposed within the storage room 14, the shelf member including a flat portion 22 on which the object is placed, and a heat storage material 40 arranged to the flat portion 22 in a way distributed depending on a temperature distribution near the flat portion within the storage room 14 during steady operation.

According to the storage container described above, since the heat storage material 40 is arranged in a region within the storage room 14 where temperature is less susceptible to the influence of heat incoming from the outside, the heat storage material 40 can be maintained in a solid state during the steady operation. In case of power outage, the interior of the storage room 14 can be reliably kept cold by utilizing the latent heat of the heat storage material 40 in the same state as that during the steady operation without exchanging the heat storage material 40.

Appendix 2

The storage container stated in Appendix 1, wherein the heat storage material 40 is arranged to be localized to a region of the flat portion 22 at a relatively low-temperature side depending on the temperature distribution.

According to the storage container described above, satisfactory keeping of temperature can be realized with the heat storage material 40 because the heat storage material is arranged in a place where the heat storage material is reliably brought into the solid state during the steady operation, for example.

Appendix 3

The storage container stated in Appendix 1 or 2, the heat storage material 40 is arranged in a thickness, measured from the flat portion 22, increasing from a high-temperature side toward the low-temperature side depending on the temperature distribution.

According to the storage container described above, since the heat storage material 40 is arranged in a region spanning from a position near the middle of the storage room 14 to the rear side where temperature is less susceptible to the influence of heat incoming from the outside, a most part of the heat storage material 40 can be maintained in the solid state during the steady operation. In case of power outage, the interior of the storage room 14 can be reliably kept cold by utilizing the latent heat of the heat storage material 40 in the same state as that during the steady operation without exchanging the heat storage material 40. Thus, according to the storage container described above, satisfactory keeping of temperature can be realized with the heat storage material 40 even in case of power outage.

Appendix 4

The storage container stated in Appendix 3, wherein the thickness of the heat storage material 42 is continuously changed.

According to the storage container described above, satisfactory keeping of temperature can be realized with the heat storage material 40 even in case of power outage.

Appendix 5

The storage container stated in Appendix 3, wherein the thickness of the heat storage material is discontinuously changed.

According to the storage container described above, satisfactory keeping of temperature can be realized with the heat storage material 40 even in case of power outage.

Appendix 6

The storage container stated in any one of Claims 1 to 5, further comprising an opening/closing door 16 to open and close the storage room 14, wherein the thickness of the heat storage material 40 increases as a distance from the opening/closing door 16 to the heat storage material increases relatively.

According to the storage container described above, the heat storage material 40 can be arranged to be localized to the region spanning from the position near the middle of the storage room 14 to the rear side where temperature is less susceptible to the influence of heat incoming from the outside, namely to be localized in an increasing amount from a region closer to the opening/closing door 16 toward a region farther away from it.

Appendix 7

The storage container stated in any one of Appendixes 1 to 6, wherein the heat storage material 43 includes a plurality of latent heat storage substances 44, 46 and 48, and respective phase change temperatures of the plural latent heat storage substances 44, 46 and 48 are different depending on the temperature distribution.

According to the storage container described above, the latent heat storage substances 44, 46 and 48 can be maintained in the solid state during the steady operation. When supply of electric power is interrupted upon, e.g., power outage, the temperature in the storage room 14 can be kept by utilizing the latent heat of the latent heat storage substances 44, 46 and 48. Furthermore, since the storage container includes the plurality of latent heat storage substances 44, 46 and 48 having the different phase change temperatures depending on the temperature distribution near the flat portion 22, satisfactory keeping of the temperature within the storage room 14 can be realized with the heat storage material 43.

Appendix 8

The storage container stated in Appendix 7, further comprising an opening/closing door 16 to open and close the storage room 14, wherein the phase change temperature is set to a lower value as a distance from the opening/closing door 16 to the latent heat storage substance increases relatively.

According to the storage container described above, if the heat storage material 48 arranged at the front side in the storage room 14 is liquefied due to a temperature rise caused by opening of the opening/closing door 16, the heat storage material 43 existing in a small amount at the front side in the storage room 14 can be solidified in a short time with cooling of the storage room 14 by a cooling mechanism after the opening/closing door 16 has been closed.

Appendix 9

A storage container that preserves an object at predetermined temperature, the storage container comprising:

a storage room 14 in which the object is preserved; and a shelf member 20 disposed within the storage room 14 and having optical transparency, the shelf member including a flat portion 22 on which the object is placed, and a heat storage material 40 arranged adjacent to the flat portion 22.

According to the storage container described above, reduction of the illuminance in a space under the heat storage material 40 can be prevented because light from a storage room lamp 34 disposed in the storage room 14 or light coming into the storage room from the outside is not blocked off by the heat storage material 40 arranged to the shelf member 20.

Appendix 10

The storage container stated in Appendix 9, wherein the heat storage material 40 has optical transparency.

According to the storage container described above, reduction of the illuminance in the space under the heat storage material 40 can be prevented.

Appendix 11

The storage container stated in Appendix 9 or 10, wherein the shelf member 20 has optical transparency in a region in which the heat storage material 54 is not arranged when looking at the flat portion 22 from a normal direction.

According to the storage container described above, since the shelf member 20 allows the light from the storage room lamp 34 for illuminating the interior of the storage room 14 to pass therethrough, the reduction of the illuminance in the space under the heat storage material 40 can be prevented.

Appendix 12

The storage container stated in any one of Appendixes 9 to 11, wherein the heat storage material 54 is arranged plural in a discrete state with respect to the flat portion.

According to the storage container described above, the heat storage material 54 can be fixed reliably.

Appendix 13

The storage container stated in any one of Appendixes 1 to 12, wherein the heat storage material 40, 42, 43, 50, 54 or 55 contains paraffin or an inorganic salt aqueous solution.

Appendix 14

The storage container stated in any one of Appendixes 1 to 13, wherein the heat storage material 40, 42, 43, 50, 54 or 55 is in a gel state.

According to the storage container described above, since the heat storage material 40, 42, 43, 50, 54 or 55 can be maintained in the solid state as a whole not only before phase change, but also after the phase change, the heat storage material is easy to handle.

Appendix 15

The storage container stated in any one of Appendixes 1 to 14, wherein the heat storage material 40, 42 or 43 is arranged at a rear surface 23 of the flat portion 22.

According to the storage container described above, since an increase in the thickness of the shelf member 20 including the heat storage material 40 can be reduced, the storage volume can be maintained without being sacrificed.

Moreover, according to the storage container described above, reserve substances can be placed on the flat portion 22 without problems.

Appendix 16

The storage container stated in any one of Appendixes 1 to 15, wherein the rear surface 23 has a corrugated shape.

According to the storage container described above, since the rear surface 23 has a corrugated shape to increase a contact area between the heat storage material 40 and the rear surface in comparison with that in the case of the rear surface 23 being flat, adhesion between the heat storage material 40 and the rear surface 23 can be increased, and the heat storage material 40 can be prevented from peeling off from the shelf member 20.

Appendix 17

The storage container stated in any one of Appendixes 1 to 16, wherein the shelf member 20 includes a tray 27 disposed under the flat portion 22, and the heat storage material 40 is arranged on the tray.

According to the storage container described above, since the heat storage material 40 can be properly fixed to and protected by the tray 27, it is possible to prevent undesired mechanical stress from being exerted on the shelf member 20, and to avoid reduction of reliability of the heat storage material 40, which may be caused by the influences of environmental changes in the storage room 14.

Appendix 18

The storage container stated in any one of Appendixes 1 to 17, wherein the heat storage material 40, 42, 43, 50, 54 or 55 is packed with a packaging 36.

According to the storage container described above, the heat storage material 40, 42, 43, 50, 54 or 55 can be protected with the packaging 36.

Moreover, according to the storage container described above, since the heat storage material is protected by the packaging 36, the performance of the heat storage material as a gas barrier or a water vapor barrier can be improved.

Appendix 19

The storage container stated in any one of Appendixes 1 to 18, wherein the packaging 36 is made of a transparent material.

According to the storage container described above, the reduction of the illuminance in the space under the heat storage material 40, 42, 43, 50, 54 or 55 can be prevented.

Appendix 20

The storage container stated in any one of Appendixes 1 to 19, wherein the heat storage material 55 is formed to be left-right symmetric when looking at the flat portion 22 from a normal direction.

According to the storage container described above, false mounting of the heat storage material 55 to the shelf member 20 can be prevented.

Appendix 21

The storage container stated in any one of Appendixes 1 to 20, further comprising a storage room lamp 34 that illuminates an interior of the storage room 14.

According to the storage container described above, the storage room 14 can be illuminated such that a user can visually recognize the reserve substances in the storage room 14.

INDUSTRIAL APPLICABILITY

The present invention can be widely utilized in storage containers for preserving objects (reserve substances) at predetermined temperatures.

REFERENCE SIGNS LIST

10, 210 storage containers
12 storage container main body
14 storage room
16 opening/closing door
18 door packing
20, 220 shelf members
22 flat portion
23 rear surface
24, 26 shelf supports
27 tray
27*a* upper edge
30, 32 heat insulators
34 storage room lamp
36, 236 packagings
40, 42, 43, 50, 54, 55 heat storage materials
44, 46, 48, 56, 58 latent heat storage substances
52 opening
70 light reflecting film
72 light-diffusing transparent film
74 recess
100 position at which temperature is measured
102, 104, 106 illuminance meters
120 optical receiver

The invention claimed is:

1. A storage container that preserves an object at a predetermined temperature, the storage container comprising:
a storage room in which the object is preserved;
a shelf member disposed within the storage room, the shelf member including a flat portion on which the object is placed, and a heat storage material arranged to the flat portion in a way distributed depending on a temperature distribution near the flat portion within the storage room during steady operation; and
an opening/closing door to open and close the storage room; wherein
the heat storage material is arranged to be localized to a region of the flat portion at a low-temperature side with respect to the flat portion at a high-temperature side;
the heat storage material is arranged in the storage room and localized to a region toward a side opposite to the opening/closing door; and
the storage container maintains the predetermined temperature in the storage room by utilizing a latent heat when a phase of the heat storage material changes from a solid phase to a liquid phase during unsteady operation.

2. The storage container according to claim 1, wherein
the shelf member has optical transparency.

3. The storage container according to claim 1,
wherein the heat storage material includes at least one of paraffin, an inorganic salt aqueous solution, an inorganic salt hydrate, and a clathrate hydrate.

4. The storage container according to claim 1,
wherein the heat storage material is arranged at a rear surface of the flat portion.

5. The storage container according to claim 4,
wherein the rear surface has a corrugated shape.

6. The storage container according to claim 1,
wherein the shelf member includes a tray disposed under the flat portion, and
the heat storage material is arranged on the tray.

7. The storage container according to claim 1,
wherein the heat storage material is packed with a packaging.

8. A storage container that preserves an object at a predetermined temperature, the storage container comprising:
a storage room in which the object is preserved;
a shelf member disposed within the storage room, the shelf member including a flat portion on which the object is placed, and a heat storage material arranged to the flat portion in a way distributed depending on a temperature distribution near the flat portion within the storage room during steady operation;
an opening/closing door to open and close the storage room; wherein
the heat storage material is arranged in a thickness, measured from the flat portion, increasing from a high-temperature side toward a low-temperature side depending on the temperature distribution;
the thickness of the heat storage material on an opposing side of the opening/closing door is greater than the thickness of the heat storage material on a side of the opening/closing door; and
the storage container maintains the predetermined temperature in the storage room by utilizing a latent heat when a phase of the heat storage material changes from a solid phase to a liquid phase during unsteady operation.

9. The storage container according to claim 8,
wherein the thickness of the heat storage material is continuously changed.

10. The storage container according to claim 8,
wherein the thickness of the heat storage material is discontinuously changed.

11. The storage container according to claim 8,
wherein the shelf member has optical transparency.

12. The storage container according to claim 8,
wherein the heat storage material includes at least one of paraffin, an inorganic salt aqueous solution, an inorganic salt hydrate, and a clathrate hydrate.

13. The storage container according to claim 8,
wherein the heat storage material is arranged at a rear surface of the flat portion.

14. The storage container according to claim 13,
wherein the rear surface has a corrugated shape.

15. The storage container according to claim 8,
wherein the shelf member includes a tray disposed under the flat portion, and the heat storage material is arranged on the tray.

16. The storage container according to claim 8,
wherein the heat storage material is packed with a packaging.

17. A storage container that preserves an object at a predetermined temperature, the storage container comprising:
a storage room in which the object is preserved;
a shelf member disposed within the storage room, the shelf member including a flat portion on which the object is placed, and a heat storage material arranged to the flat portion in a way distributed depending on a temperature distribution near the flat portion within the storage room during steady operation; and an opening/closing door to open and close the storage room; wherein the heat storage material includes a plurality of latent heat storage substances;

respective phase change temperatures of the plurality of latent heat storage substances are different depending on the temperature distribution;

the respective phase change temperatures of the plurality of latent heat storage substances arranged on a side of the opening/closing door is greater than the respective phase change temperatures of the plurality of latent heat storage materials arranged on an opposing side of the opening/closing door; and the storage container maintains the predetermined temperature in the storage room by utilizing a latent heat when a phase of the heat storage material changes from a solid phase to a liquid phase during unsteady operation.

18. The storage container according to claim 17, wherein the heat storage material includes at least one of paraffin, an inorganic salt aqueous solution, an inorganic salt hydrate, and a clathrate hydrate.

* * * * *